US009580965B2

(12) United States Patent
Savage et al.

(10) Patent No.: US 9,580,965 B2
(45) Date of Patent: Feb. 28, 2017

(54) MULTIPLE MOTOR/PUMP ARRAY

(75) Inventors: John K. Savage, Edmonton (CA); Kennedy J. Kirkhope, Leduc (CA)

(73) Assignee: Halliburton Energy Services, Inc., Houston, TX (US)

( * ) Notice: Subject to any disclaimer, the term of this patent is extended or adjusted under 35 U.S.C. 154(b) by 924 days.

(21) Appl. No.: 13/365,619

(22) Filed: Feb. 3, 2012

(65) Prior Publication Data

US 2012/0201659 A1 Aug. 9, 2012

Related U.S. Application Data

(60) Provisional application No. 61/440,594, filed on Feb. 8, 2011.

(51) Int. Cl.

| | |
|---|---|
| ***F04D 13/10*** | (2006.01) |
| ***E21B 4/16*** | (2006.01) |
| ***E21B 4/02*** | (2006.01) |
| ***F04D 13/12*** | (2006.01) |

(52) U.S. Cl.
CPC ..... *E21B 4/16* (2013.01); *E21B 4/02* (2013.01); *F04D 13/10* (2013.01); *F04D 13/12* (2013.01)

(58) Field of Classification Search
CPC ... E21B 4/02; E21B 7/068; E21B 4/16; F04D 19/046; F04D 13/12; F04D 29/42
USPC ..... 415/143, 182.1; 175/92, 95, 107
See application file for complete search history.

(56) References Cited

U.S. PATENT DOCUMENTS

| | | | | |
|---|---|---|---|---|
| 3,036,645 | A | 5/1962 | Rowley | 175/93 |
| 3,356,338 | A | 12/1967 | Ioanesyan et al. | 415/144 |
| 3,362,488 | A | 1/1968 | Ioanesyan | 175/93 |
| 3,449,030 | A | 6/1969 | Tiraspolsky et al. | 308/230 |
| 3,489,231 | A | 1/1970 | Garrison et al. | 175/323 |
| 3,594,106 | A | 7/1971 | Garrison | 103/117 |
| 3,630,634 | A | 12/1971 | Mayall | 415/170 |
| 3,666,330 | A | 5/1972 | Dicky et al. | 384/126 |
| 3,754,835 | A | 8/1973 | Ivanov et al. | 415/122 |
| 3,840,080 | A | 10/1974 | Berryman | 175/107 |
| 3,879,094 | A | 4/1975 | Tschirky et al. | 308/230 |
| 3,894,818 | A | 7/1975 | Tschirky | 418/48 |
| 3,936,247 | A | 2/1976 | Tschirky et al. | 418/48 |
| 3,944,303 | A | 3/1976 | Ioanesian et al. | 308/6 |
| 4,029,368 | A | 6/1977 | Tschirky et al. | 308/8.2 |
| 4,133,397 | A | 1/1979 | Tschirky | 175/96 |
| 4,135,772 | A | 1/1979 | Stodt | 308/227 |
| 4,199,201 | A | 4/1980 | Trzeciak | 308/8.2 |
| 4,240,683 | A | 12/1980 | Crase | 308/227 |

(Continued)

FOREIGN PATENT DOCUMENTS

WO WO 92/19835 A1 11/1992

OTHER PUBLICATIONS

Englished translated version of the description of Akteingesellschaft WO1992019835, Hydraulically Driven Drilling Motor for Deep Drilling, Nov. 1992.*

(Continued)

*Primary Examiner* — Michael Wills, III

(74) *Attorney, Agent, or Firm* — Chamberlain Hrdlicka

(57) ABSTRACT

According to one embodiment, a multiple motor and/or pump array module for a drilling tool comprises a plurality of motors and/or pumps extending axially along generally parallel axes wherein the pumps are positioned along the axes next to each other in a parallel manner in generally the same axial location.

23 Claims, 18 Drawing Sheets

(56) References Cited

U.S. PATENT DOCUMENTS

| | | | | |
|---|---|---|---|---|
| 4,260,202 | A | 4/1981 | Crase et al. | 308/8.2 |
| 4,388,973 | A | 6/1983 | Winkelmann et al. | 175/321 |
| 4,501,454 | A | 2/1985 | Dennis et al. | 384/619 |
| 4,511,193 | A | 4/1985 | Geczy | 384/611 |
| 4,729,675 | A | 3/1988 | Trzeciak et al. | 384/613 |
| 5,150,972 | A | 9/1992 | Wenzel | 384/97 |
| 5,248,896 | A | 9/1993 | Forrest | 290/1 R |
| 5,911,284 | A * | 6/1999 | von Gynz-Rekowski | 175/107 |
| 6,183,226 | B1 * | 2/2001 | Wood et al. | 418/48 |
| 6,247,533 | B1 | 6/2001 | Brett | 166/65.1 |
| 6,269,892 | B1 | 8/2001 | Boulton et al. | 175/61 |
| 6,470,977 | B1 | 10/2002 | Chen et al. | 175/61 |
| 6,488,103 | B1 * | 12/2002 | Dennis et al. | 175/19 |
| 6,523,624 | B1 | 2/2003 | Cousins et al. | 175/386 |
| 6,581,699 | B1 | 6/2003 | Chen et al. | 175/61 |
| 6,659,203 | B1 | 12/2003 | Cruickshank et al. | 175/107 |
| 6,945,328 | B2 | 9/2005 | Cruickshank et al. | 166/298 |
| 7,147,066 | B2 | 12/2006 | Chen et al. | 175/61 |
| 7,204,324 | B2 | 4/2007 | Gleitman et al. | 175/57 |
| 7,234,543 | B2 | 6/2007 | Schaaf | 175/61 |
| 7,407,020 | B2 | 8/2008 | Gleitman et al. | 175/57 |
| 7,416,034 | B2 | 8/2008 | Downie et al. | 175/107 |
| 7,467,672 | B2 | 12/2008 | Cruickshank | 175/61 |
| 7,481,281 | B2 | 1/2009 | Schuaf | 175/61 |
| 7,600,586 | B2 * | 10/2009 | Hall et al. | 175/61 |
| 7,918,290 | B2 * | 4/2011 | Rushton | 175/107 |
| 8,770,317 | B2 * | 7/2014 | Kolle | 175/71 |
| 2006/0102388 | A1 * | 5/2006 | Dennis et al. | 175/57 |
| 2006/0113114 | A1 * | 6/2006 | Jin et al. | 175/67 |
| 2006/0245945 | A1 | 11/2006 | Wilson et al. | 417/405 |
| 2006/0254819 | A1 * | 11/2006 | Moriarty | 175/40 |
| 2008/0264693 | A1 | 10/2008 | Downie et al. | 175/106 |
| 2009/0272581 | A1 * | 11/2009 | Beylotte et al. | 175/107 |
| 2011/0129375 | A1 * | 6/2011 | Kotsonis | 418/4 |

OTHER PUBLICATIONS

International Search Report corresponding to co-pending International Patent Application Serial No. PCT/US2012/023803, Korean Intellectual Property Office, dated Sep. 26, 2012; (7 pages).

International Written Opinion corresponding to co-pending International Patent Application Serial No. PCT/US2012/023803, Korean Intellectual Property Office, dated Sep. 26, 2012; (8 pages).

* cited by examiner

MULTIPLE MOTOR/PUMP ARRAY

REFERENCE TO RELATED APPLICATIONS

This application claims the benefit of U.S. Provisional Patent Application Ser. No. 61/440,594, filed Feb. 8, 2011, and titled "Multiple Motor/Pump Array," which is incorporated herein by reference in its entirety.

FIELD OF THE INVENTION

The present disclosure relates to motors and pumps for drilling applications. Specifically, the present disclosure relates to arrays of motors and/or pumps.

BACKGROUND OF THE INVENTION

Progressive cavity pump style motors exist and have been employed in conjunction with power sections of drilling tools. These motors employ stators having one more lobe than associated rotors. There exists a trend to increase the number of lobes in the rotors and stators. However, increasing the number of lobes leads to complicated geometries and generally increases the costs of manufacturing such motors. Additionally, employing motors having an increasing numbers of lobes leads to low speed, high torque power generation modules.

Directional drilling tool drive trains utilize a single drilling fluid motor power section or multiple power sections arranged in series driving around a bend through a constant velocity shaft or solid torsion shaft.

DETAILED DESCRIPTION OF THE ILLUSTRATED EMBODIMENTS

Figure 1A:
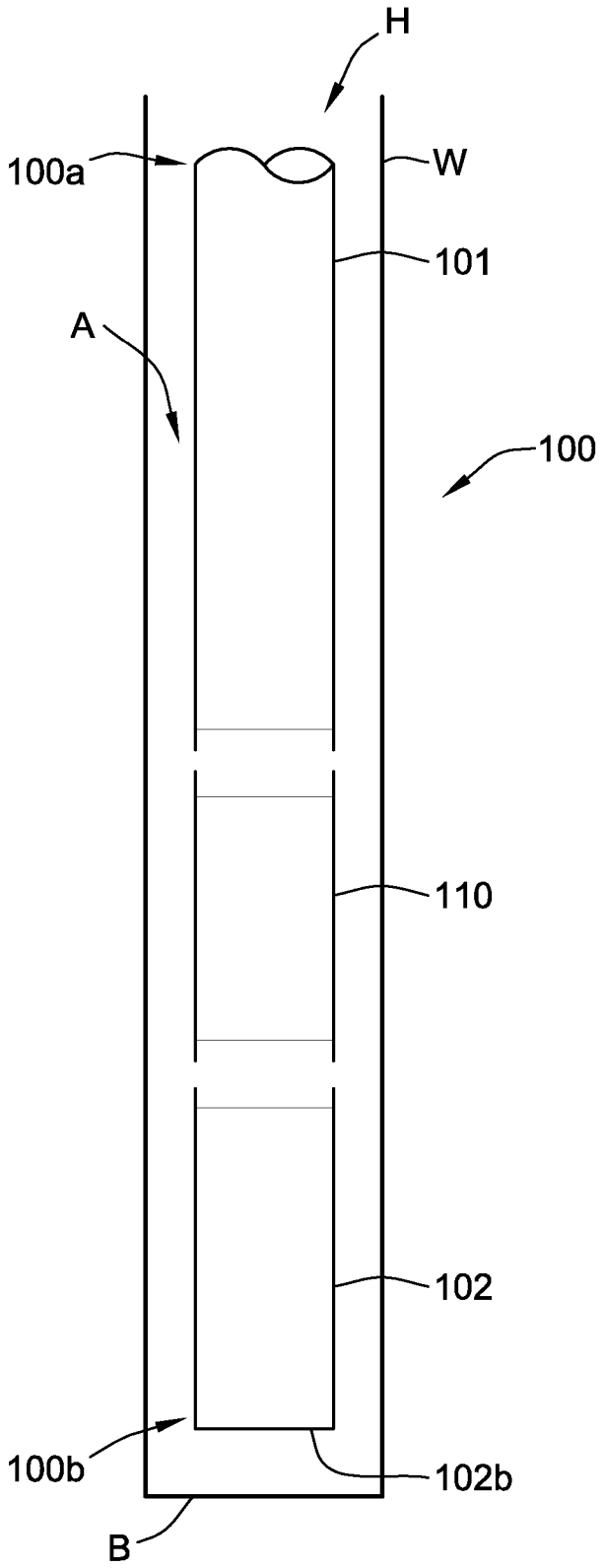
FIG. 1A is a schematic illustration of a drilling assembly employing a down-hole application of a multiple motor/pump array according to an embodiment of the present disclosure.
Figure 1B:
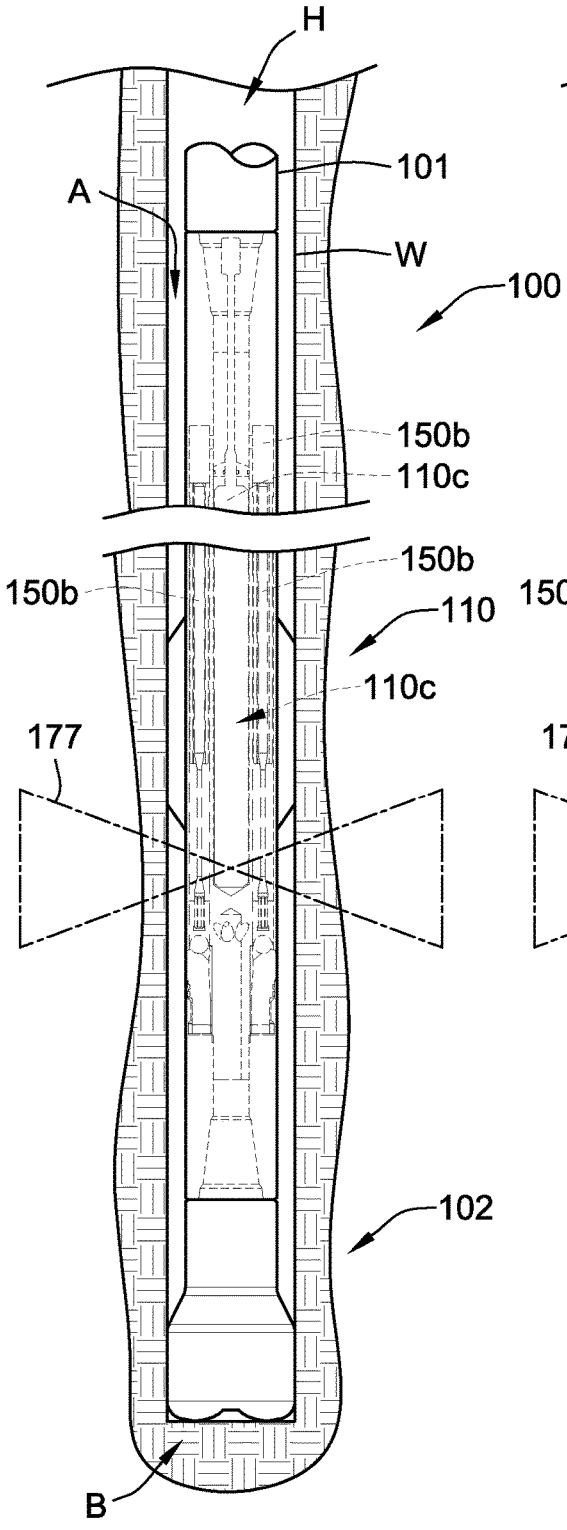
FIG. 1B is a schematic illustration of a drilling assembly employing a down-hole application of an exemplary multiple motor array powering a steering mechanism according to an embodiment of the present disclosure.
Figure 1C:
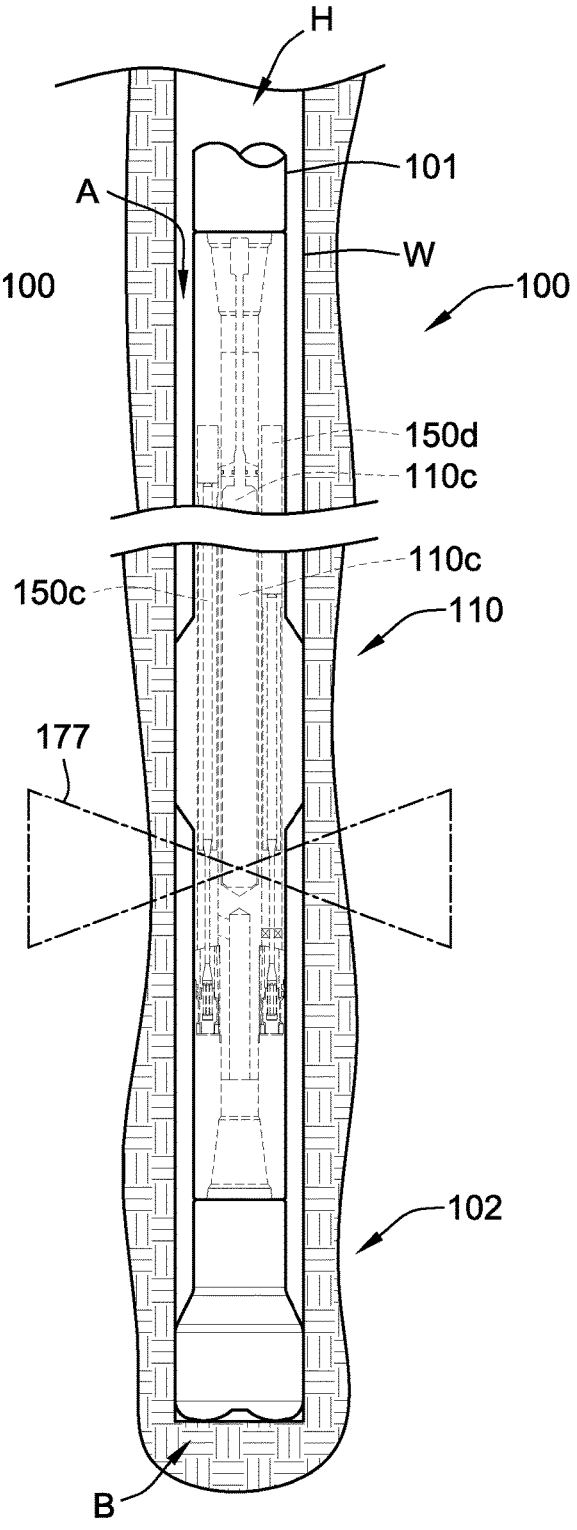
FIG. 1C is a schematic illustration of a drilling assembly employing a down-hole application of a combination of an exemplary multiple motor array powering a drive mechanism and an exemplary driven multiple pump array according to an embodiment of the present disclosure.

FIG. 1A is a schematic illustration of a drilling assembly 100 employing a down-hole application of a multiple motor/pump array according to an embodiment of the present disclosure. FIG. 1B is a schematic illustration of a drilling assembly 100 employing a down-hole application of an exemplary multiple motor array powering a steering mechanism according to an embodiment of the present disclosure. FIG. 1C is a schematic illustration of a drilling assembly 100 employing a down-hole application of an exemplary multiple motor array powering a drive mechanism and an exemplary driven multiple pump array according to an embodiment of the present disclosure. The drilling assembly comprises a string 101 coupled directly or indirectly to a multiple motor and/or pump array module 110 coupled directly or indirectly to a drill bit assembly 102 within a hole H having a bore wall B. The drill bit assembly 102 is positioned at or near the bottom B of the hole H. The multiple motor and/or pump array module 110 may comprise the various motors/pumps and motor and/or pump arrays described herein such as in connection with FIGS. 2A-8D. For example, the power generation modules 210 or 400 or drive array 300 may be employed to drive a drill bit 102. In operation, according to some embodiments, drilling fluid flows through the string 101, the multiple motor and/or pump array module 110, and the drill bit assembly 102 and out of the bottom 102*b* of the drill bit assembly 102. According to some embodiments, drilling fluid exiting the bottom 102*b* of the drill bit assembly 102 then flows upward in an annulus A formed between the walls W of the hole H and the outside of the drill bit assembly 102, the multiple motor array module 110, and the string 101. According to some embodiments, the flow of the drilling fluid through the multiple motor and/or pump array module 110 drives the various motors and/or pump described herein such as motors 250/350. According to some embodiments, drilling fluid may flow into the multiple motor and/or pump array module 110 and out of the multiple motor and/or pump array module 110 and into the annulus A. The orientation of the drilling assembly 100 can be understood with reference to an up-hole portion 100*a* and a down-hole portion 100*b*.

Referring to FIGS. 1B and 1C, the multiple motor and/or pump array module 110 may contain a location or a cavity 110*c* for housing various electronics such as sensors. Exemplary fields of view 177 of sensors are shown in FIGS. 1B and 1C. As illustrated in FIG. 1B, multiple motor and/or pump array module 110 comprises a plurality of steering motors 150*b* arranged in parallel. As illustrated in FIG. 1C, multiple motor and/or pump array module 110 comprises one or more driven motors 150*c* arranged in parallel with one or more driven pumps 150*d*.

Figure 2A:
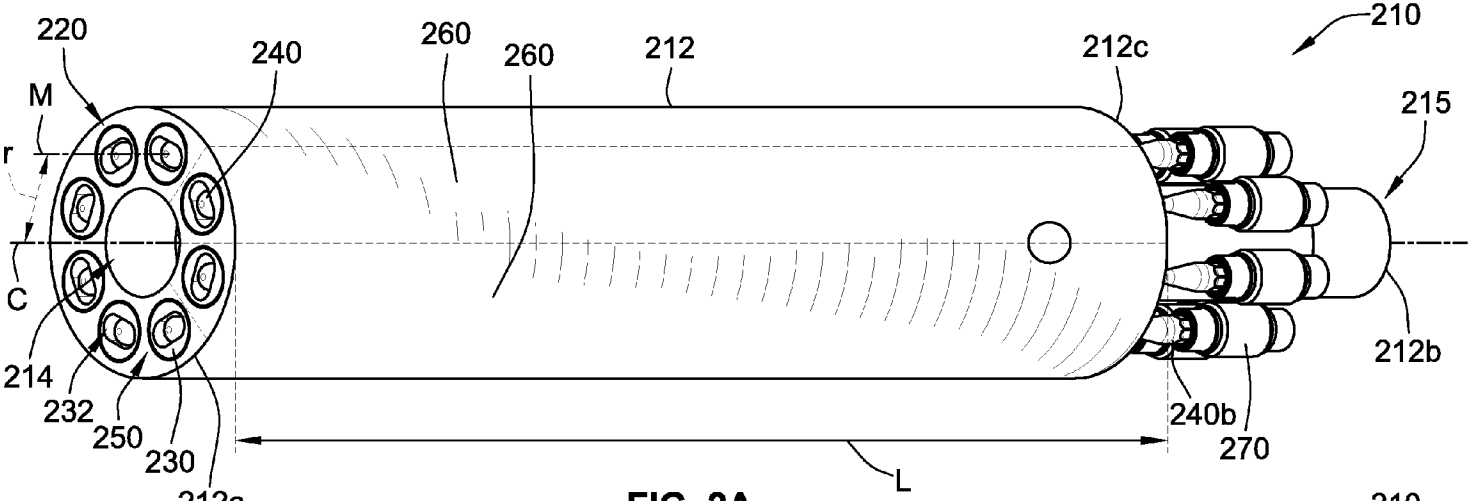
FIG. 2A is a perspective view of a power generation module according to one embodiment of the present disclosure.
Figure 2B:
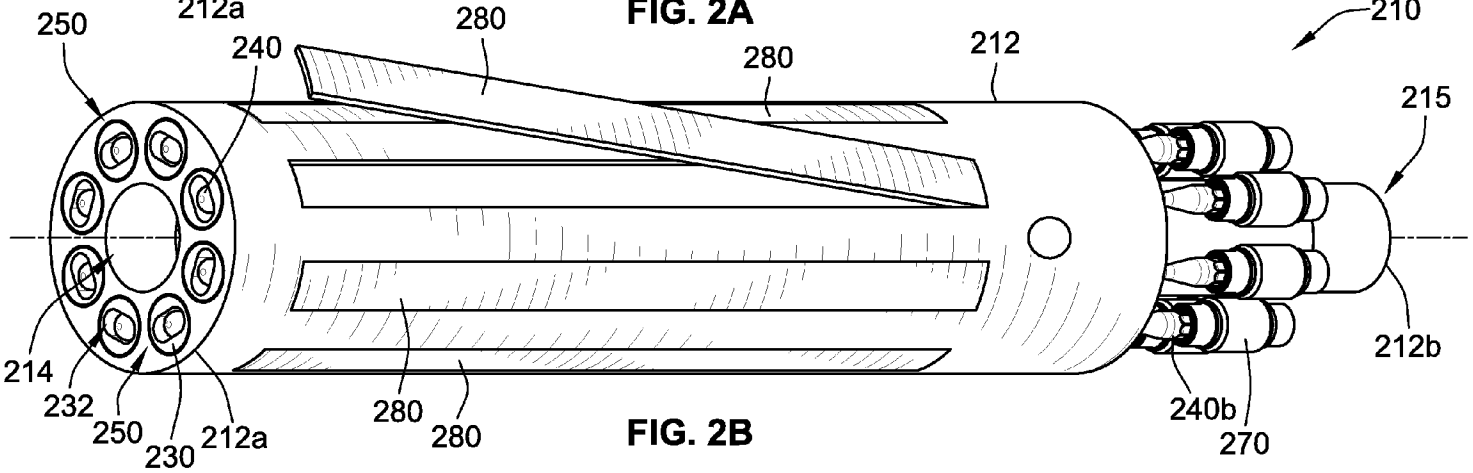
FIG. 2B is a perspective view of a power generation module within a tool according to one embodiment of the present disclosure.

FIG. 2A is a perspective view of power generation module 210 according to one embodiment of the present disclosure. The power generation module comprises a housing 212 extending longitudinally or axially along a central axis C. According to some embodiments, an up-hole central cavity 214 is formed in the housing 212 and extends from an up-hole end 212*a* of the housing 212 toward a down-hole end 212*b* of the housing 212. According to some embodiments, a down-hole central cavity 215 is formed in the housing 212 and extends from the down-hole end 212*b* of the housing 212 toward the up-hole end 212*a* of the housing 212. According to some embodiments, the housing 212 alternatively or additionally comprises a plurality of motor/pump bores or cavities 220 extending longitudinally generally parallel to but off-axis from the central axis C of the housing. Positioned within each cavity 220 is a stator 230. Each stator 230 defines a stator cavity 232. Positioned within each stator cavity 232 is a rotor 240. Each rotor 240 and stator 230 pair form a motor 250. Accordingly, according to some embodiments, an array of motors 250 is provided wherein each motor 250 extends generally longitudinally parallel to the other motors 250 in the array but wherein each motor 250 is displaced radially from a central axis C. For example, one motor 250 is shown in FIG. 2A extending longitudinally or axially along axis M wherein axis M is parallel or generally parallel to axis C. Axis M is generally radially offset from axis C by a distance r. According to some embodiments and as illustrated in FIG. 2A, the other motors 250 extend longitudinally or axially along axes parallel or generally parallel to axes C and M and also being radially displaced from axis C by the same distance r—that is, the array of motors 250 are arranged circularly about axis C.

Figure 2C:
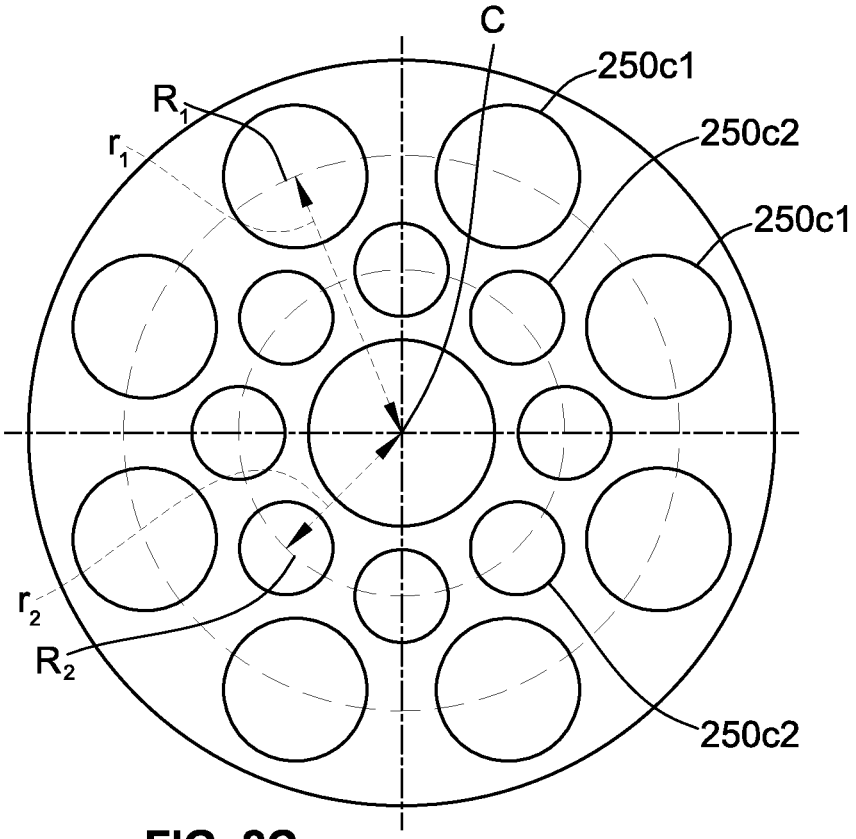
FIG. 2C is a partial end cross-sectional view illustrating two concentric rings of motors and/or pumps according to one embodiment of the present disclosure.

According to other embodiments, the distances between the motor axes of motors 250 and central axis C need not be the same. For example, according to some embodiments, a plurality of motors and/or pumps are arranged in concentric rings about central axis C such as shown in FIG. 2C or arranged in other types of pattern or arranged in an irregular arrangement. FIG. 2C is a partial end cross-sectional view illustrating two concentric rings of motors and/or pumps according to one embodiment of the present disclosure. As illustrated in FIG. 2C an outside ring of larger motors and/or pumps 250*c*1 surrounds an inner ring of smaller motors and/or pumps 250*c*2. Both rings are concentric about central axis C. As depicted, motors and/or pumps 250*c*1 are equally spaced about the circumference of a ring $R_1$ having a radius of $r_1$. As depicted, motors and/or pumps 250*c*2 are equally spaced about the circumference of a ring $R_2$ having a radius of $r_2$. As depicted, radius $r_1$ is greater than radius $r_2$.

Figure 2D:
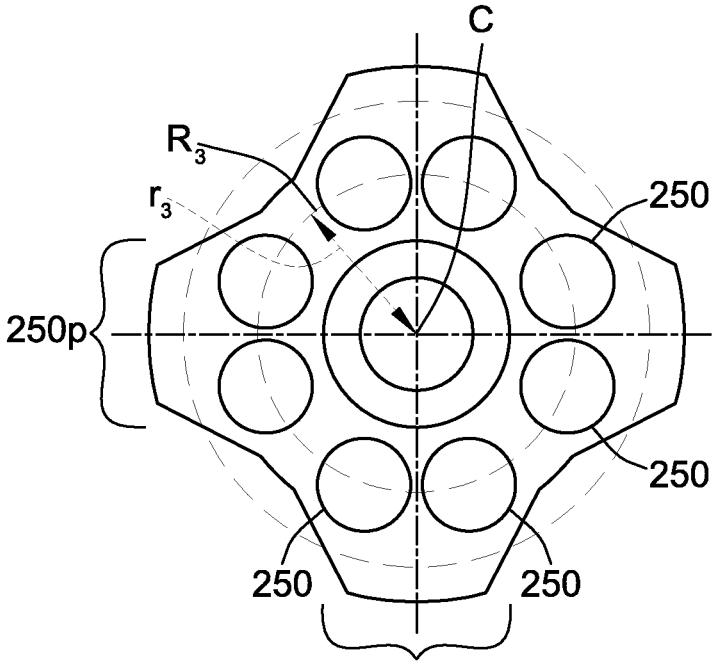
FIG. 2D is a partial end cross-sectional view illustrating another arrangement of motors and/or pumps according to one embodiment of the present disclosure.

FIG. 2D is a partial end cross-sectional view illustrating another arrangement of motors and/or pumps 250 according to one embodiment of the present disclosure. As depicted, motors and/or pumps 250 are not equally spaced about the circumference of a ring $R_3$ having a radius of $r_3$. Rather, the motors and/or pumps 250 are grouped in pairs 250*p* and each pair 250*p* of motors and/or pumps 250 are equally spaced about the circumference of the ring $R_3$.

Returning to FIG. 2A, according to some embodiments, the down-hole ends 240*b* of the rotors 240 extend beyond an intermediate down-hole end 212*c* of the housing 212. The down-hole ends 240*b* can be coupled to various attachments and/or can be employed in various manners. As illustrated in FIG. 2A, gears 270 are coupled to the down-hole ends 240*b* of the rotors 240.

According to some embodiments, each rotor 240 and stator 230 pair is a progressive cavity pump or motor based on the Moineau principle. According to some embodiments, each rotor has one lobe and each stator has two lobes—each motor (or pump) 250 having a one-two configuration. According to some embodiments, in operation, drilling drilling fluid flows through one or more of the motors 250 causing the rotor 240 within in each motor to rotate within a corresponding stator 230. Such one-two configuration motors facilitate high-speed operation with individual motors tending to produce lower torque. According to some embodiments, other lobe configurations may be employed in conjunction with the motor (or pump) arrays described herein, such as, for example, multiple lobe configurations such as a two-three configuration, a four-five configuration, a nine-ten configuration, etc. In general, according to some embodiments, single-lobe and/or multi-lobe motors (or pumps) may be employed.

According to some embodiments, turbines used as motors or pumps may be employed in the various embodiments described herein in place of or in addition to the progressive cavity pump or motor arrays described herein.

According to some embodiments, smaller higher speed drilling fluidmotor power sections are employed in a parallel array such as motors 250 shown in FIG. 2A. The array can be distributed in bores 220 radially displaced off the central axis C of the main housing 212. Advantageously, higher speed motors such as those having a one-two configuration tend to be cheaper to manufacture having more simple geometry.

According to some embodiments, the positioning of the motors next to each other in the same longitudinal or axial location (that is, near the same position along an up-hole/down-hole direction) such as longitudinal or axial location L permits the motors to be driven in parallel as drilling fluid flows through a module containing the array of motors 250/350—as opposed to multiple motors arranged serially along an up-hole/down-hole direction such as axis C.

Thus, according to some embodiments, a parallel array of high-speed, low torque motors are provided. According to some embodiments, to increase the torque available, the individual torques provided by individual motors of the array can be combined so that the multiple parallel motor array module can provide a high torque output. For example, as will be described below in connection with FIGS. 3D-3G, according to some embodiments, gears on the rotors of multiple motors in the array can be used collectively to drive a common final drive.

According to some embodiments, the housing 212 is metal such as a non-magnetic metal or alloy steel. According to some embodiments wherein electrical sensors and/or electrical power generation devices are contained within the housing 212, the housing is made of non-magnetic metal.

According to some embodiments, the housing comprises a plurality of standardized sections 260, each section comprising a portion of the housing 212, one or more cavities 220 within which corresponding motors 250 are positioned. According to some embodiments, the standardized sections 260 comprise readily replaceable cartridges consisting of rotor and stator pairs. According to some embodiments, each section 260 is modular and can be removed and replaced with new sections 260 as needed. Such modular outserts allow the sections 260 to be swapped outside a tool within which the power generation module 210 may be placed. Alternatively, according to some embodiments, the stator cavities can be directly formed and located in the housing itself and the housing or sections thereof made replaceable. That is, the cavities 220 can be formed in the configuration of stators wherein the cavities 220 serve as stators 230. According to some embodiments, the motors 250 are standardized and replaceable such that a power generation module 210 having one or more broken or damaged motors 250 may be repaired by simply removing one motor 250 (rotor 240/stator 230 pair) from a cavity 220 and replacing it with another motor 250, e.g., by sliding a motor 250 axially out of a cavity 220 and sliding another motor 250 axially into the cavity 220.

According to some embodiments, the above modularity provides the opportunity to replace portion of a power section without having to tear apart a tool within which a power section is located. For example, referring to FIG. 2B which is a perspective view of a power generation module within a tool 290 according to one embodiment of the present disclosure, the housing 212 of the tool 290 has detachable covers or caps 280 which may be removed from the tool 290. Removing a detachable cover 280 permits an adjacent motor (stator/rotor tube) to be removed from the tool 290 and replaced with a new motor. Once a new motor has been inserted into the tool, the detachable cover 280 can be reattached to the housing 212 of the tool 290. Accordingly, individual motors may be replaced in much the same manner that a battery is replaced in many consumer electronic devices. Such embodiments employing radially accessible motor compartments provide the benefit of permitting the tool 290 to be repaired at a rig site.

According to some embodiments, a drilling tool utilizes an array of high speed motors operating in parallel and whose axis lay radially off a central axis of the tool, such as in a circular pattern about the tool axis. For example, referring to FIG. 2A, the power generation module 210 may be employed in a drilling tool having a central axis C.

According to some embodiments, cavities 220 may be formed in housing 212 as the housing is being manufactured. Alternatively, according to some embodiments, housing 212 may initially be formed without cavities 220 and subsequently, cavities 220 may be drilled into the housing 212.

Figure 3A:
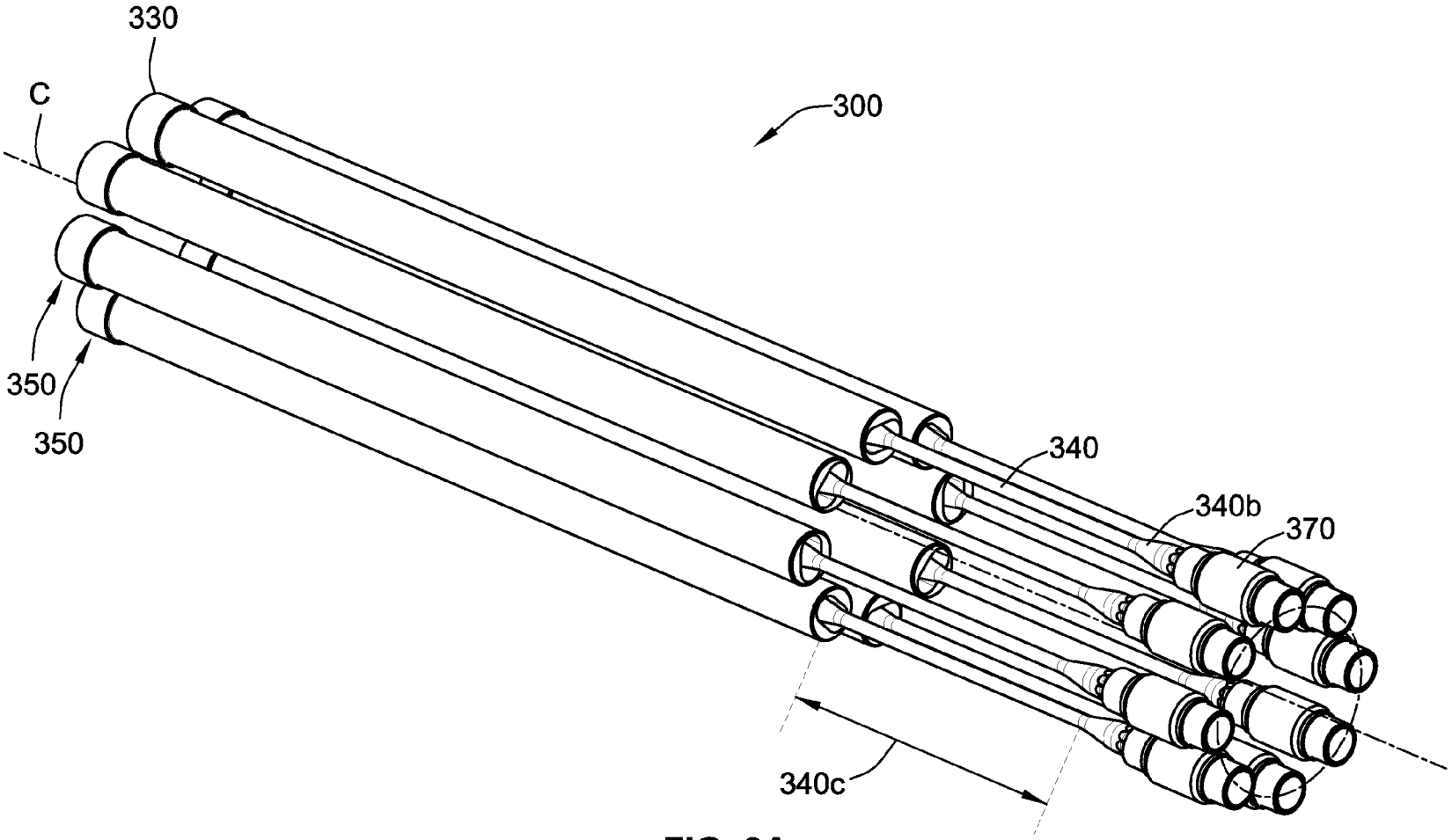
FIG. 3A illustrates a perspective view of a drive array or section according to one embodiment of the present disclosure.

FIG. 3A illustrates a perspective view of a drive array or drive section 300 according to one embodiment of the present disclosure. The drive array or drive section 300 comprises a plurality of power sections or motors 350 extending longitudinally generally parallel to but off-axis from a central axis C. According to some embodiments, the motors 350 are arranged symmetrically about the central axis C. According to some embodiments, the motors 350 are the same or similar to the motors 250 of FIG. 2A. The motors 350 comprise stator 330 and rotor 340 pairs. As illustrated in FIG. 3A, gears 370 are coupled to the downhole ends 340*b* of the rotors 340. According to some embodiments, each motor 350 has a one-two configuration. According to some embodiments, each rotor 340 has a torsion rod section 340*c*.

According to some embodiments, the drive array 300 provides an at-bit torque application. By reducing the size of the individual power section/motor 350, the drive array 300 reduces the mechanical loads borne by each power section/motor 350. As a result, according to some embodiments, the drive array 300 employs torsion rod sections 340*c* of rotors 340 for transmitting power around a bend instead of constant velocity joints. According to some embodiments, the torsion rod sections 340*c* are machined into the rotor material 340 itself so an integral rotor 340/torsion section 340*c* component exist. Such integral embodiments avoid the need for threaded joints or other coupling means to join a separate stator 340 and torsion section 340*c*. However, according to some embodiments, separate stators 340 and torsion sections 340*c* may be employed in conjunction with the various embodiments discussed in this disclosure.

The individual motors 350 form a parallel array around a bend where they combine to provide the required composite torque. According to some embodiments, the transmission used to combine the parallel effort can be a sealed and compensated oil lubricated gear set driving a ring gear on the inside diameter of the bit subassembly (see, e.g., FIGS. 3D-3E) or a gear on the outside diameter of a bit subassembly shaft as shown in FIGS. 3E, 3F, and 4. The transmission can alternately be of a spring loaded taper design as friction coupling to operate in a drilling fluid environment as illustrated in FIGS. 3H-3I.

Figure 3B:
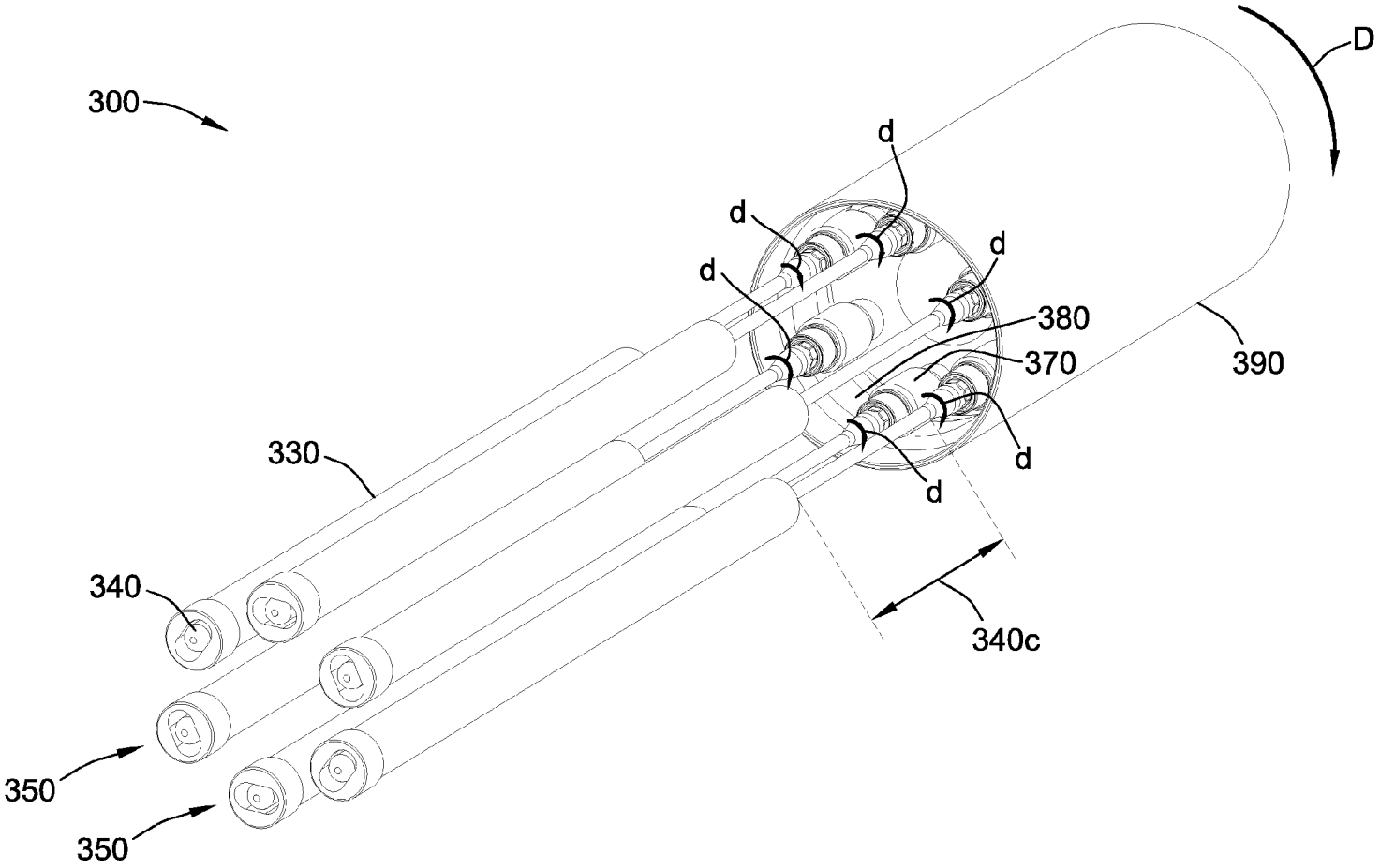
FIG. 3B is a perspective view of a drive array or section coupled to a bit subassembly according to one embodiment of the present disclosure.
Figure 3C:
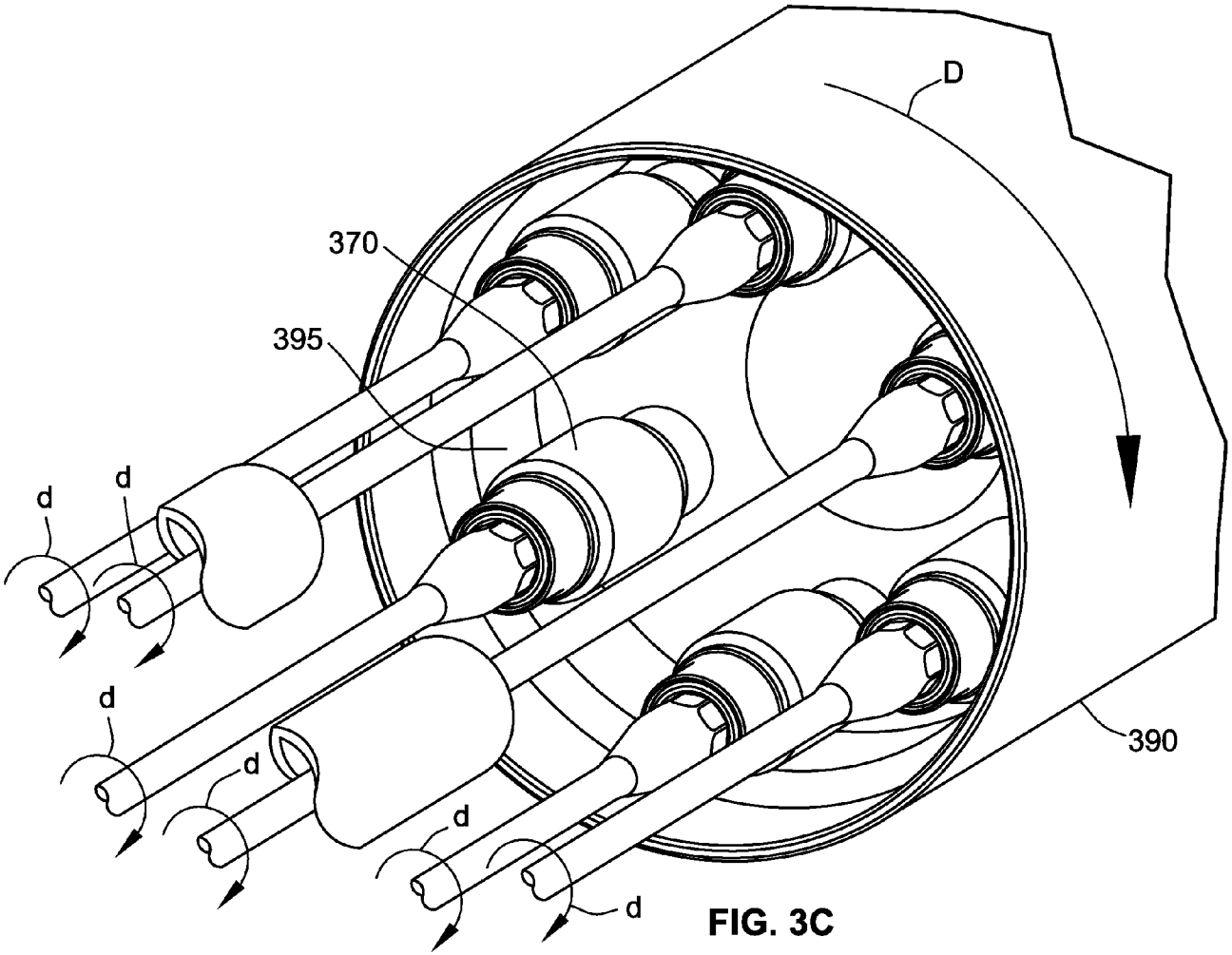
FIG. 3C is an enlarged perspective view of gears of drive array 300 engaging an inside diameter of a bit subassembly.

FIG. 3B is a perspective view of a drive array 300 coupled to a bit subassembly 390. FIG. 3C is an enlarged perspective view of gears 370 of drive array 300 engaging an inside diameter 395 of a bit subassembly 390. As seen in FIG. 3C, the gears 370 contact an inside diameter 395 of the bit subassembly 390. In operation, drilling fluid flowing downhole through the motors 350 drive the individual gears 370 in a rotational manner such as in a counterclockwise direction d as shown in FIGS. 3B and 3C. The gears 370 collectively engaged the inner diameter 395 of the bit subassembly 390 and drive the bit subassembly 390 in a rotational manner such as in a counterclockwise direction D as shown in FIGS. 3B and 3C. The individual torques provided by individual gears 370 are then combined to provide a larger torque by bit subassembly 390.

Figure 3D:
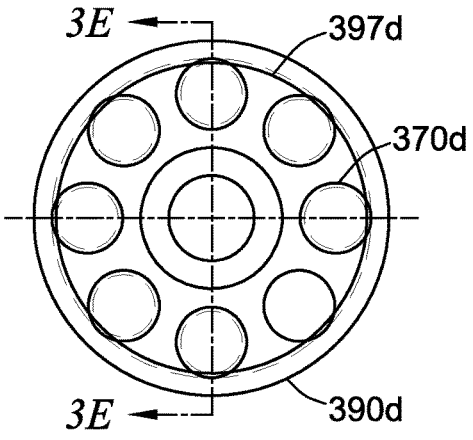
FIG. 3D is a partial end cross-sectional view and FIG. 3E is a partial side cross-sectional view along line 3E-3E of FIG. 3D illustrating a sealed and compensated oil lubricated gear set driving a ring gear on the inside diameter of the bit subassembly.
Figure 3E:
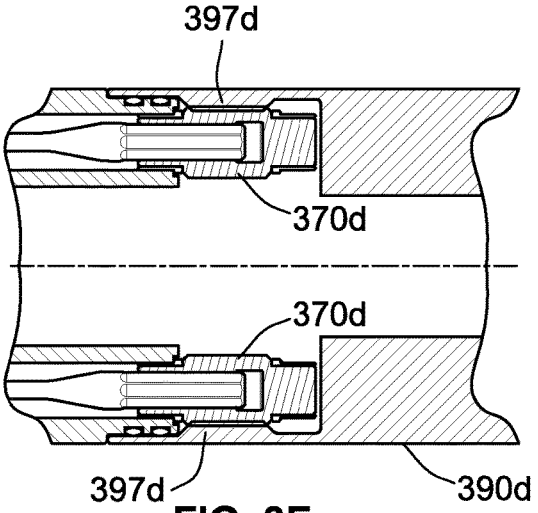
Figure 3F:
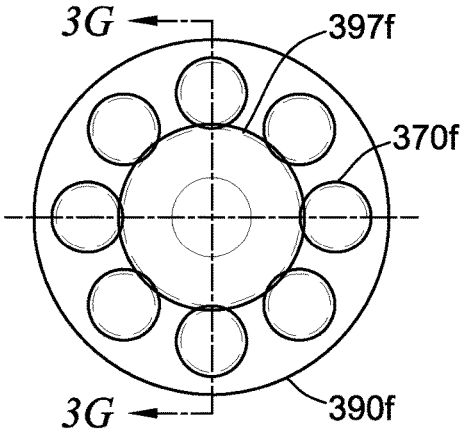
FIG. 3F is a partial end cross-sectional view and FIG. 3G is a partial side cross-sectional view along line 3G-3G of FIG. 3F illustrating a sealed and compensated oil lubricated gear set driving a sun gear on an outside diameter of a bit subassembly shaft.
Figure 4:
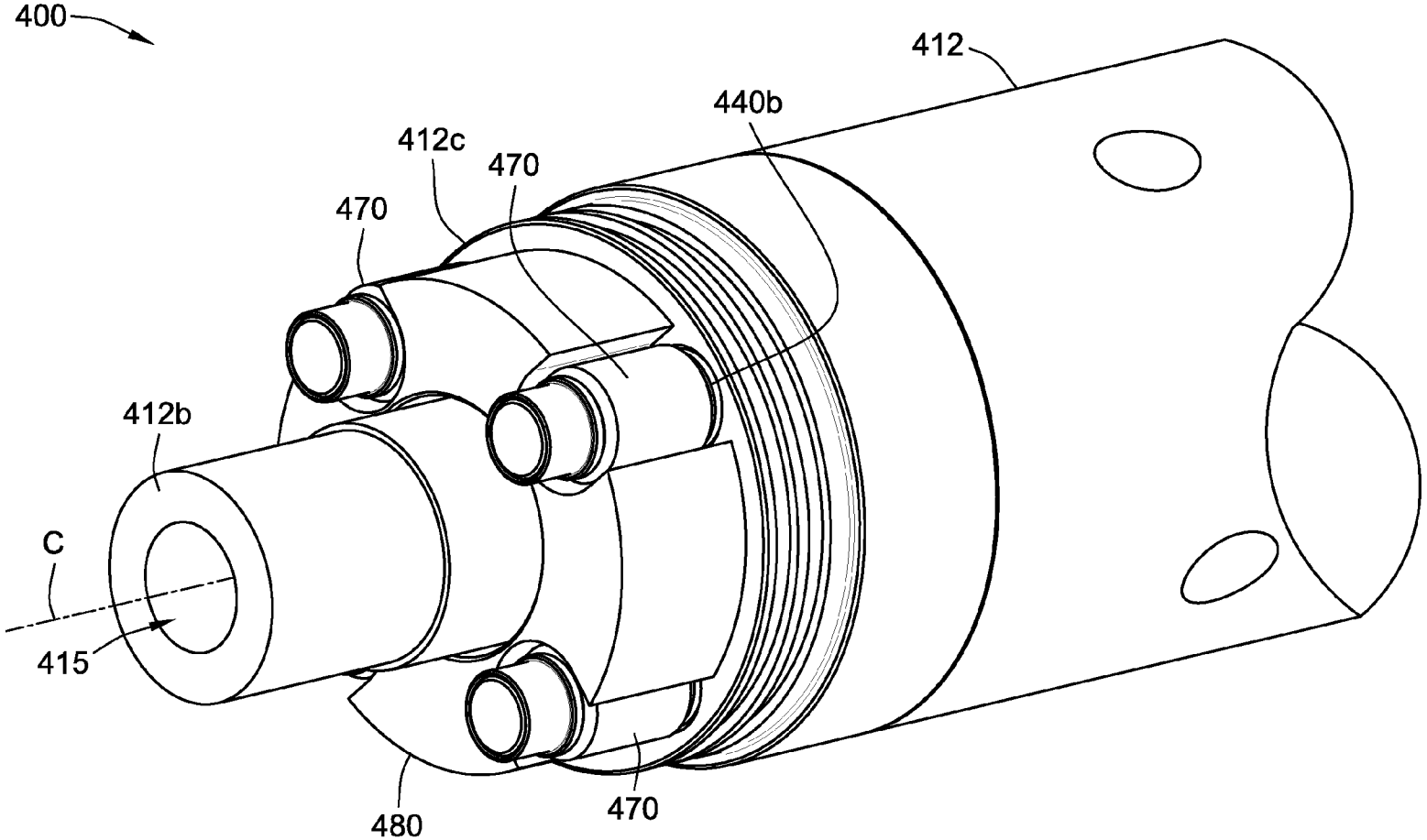
FIG. 4 is a perspective view of a power generation module according to one embodiment of the present disclosure.

FIG. 3D is a partial end cross-sectional view and FIG. 3E is a partial side cross-sectional view along line 3E-3E of FIG. 3D illustrating a sealed and compensated oil lubricated gear set driving a ring gear 397D on the inside diameter of the bit subassembly 390D. Gears 370D of a drive array engage a ring gear 397D of bit subassembly 390D.

Figure 3G:
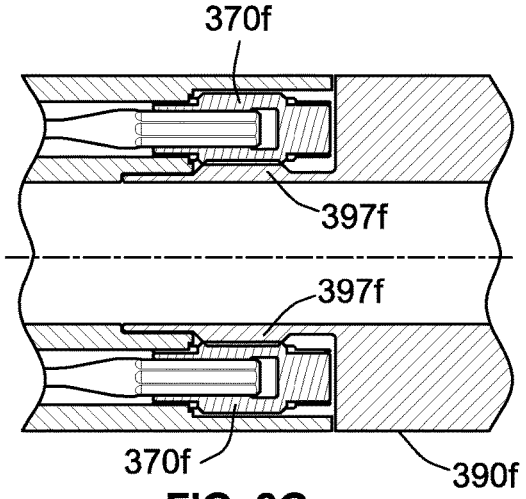
Figure 3H:
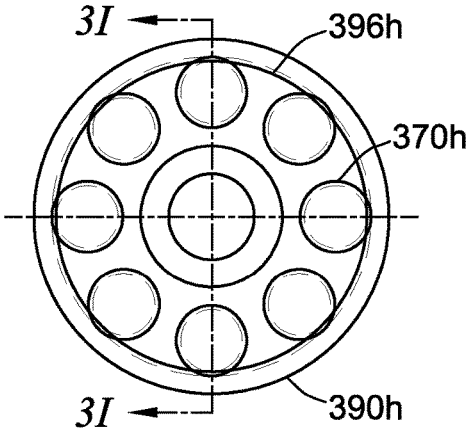
FIG. 3H is a partial end cross-sectional view and FIG. 3I is a partial side cross-sectional view along line 3I-3I of FIG. 3H illustrating spring loaded taper design for operating in a process fluid environment.
Figure 3I:
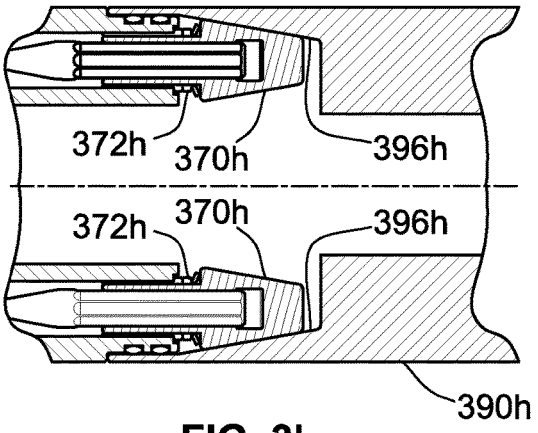

FIG. 3F is a partial end cross-sectional view and FIG. 3G is a partial side cross-sectional view along line 3G-3G of FIG. 3F illustrating a sealed and compensated oil lubricated gear set driving a sun gear 397F on an outside diameter of a bit subassembly shaft 390F. Gears 370F of a drive array engage a sun gear 397F of bit subassembly 390F.

FIG. 3H is a partial end cross-sectional view and FIG. 3I is a partial side cross-sectional view along line 31-31 of FIG. 3H illustrating spring loaded taper design for operating in a drilling fluid environment. Spring-loaded tapered gears 370H of a drive array frictionally engage an inside diameter 396H of bit subassembly 390H. Springs 372H bias the tapered gears 370H into engagement with the inside diameter 396H of bit subassembly 390H Motor sections can be located further up the bit bend to provide windows for electronics to see through to the bore, such as for example, in the vicinity of torsion rod sections 340*c*. Larger tools can use the same common motors 350 in a larger array 300 to increase power requirements. That is, while eight motors 350 are depicted in array 300, according to some embodiments, array 300 comprises an array of more than eight motors, such as for example, nine to twelve or fourteen motors. According to some embodiments, a motor and/or pump array may have between two and 130 motors and/or pumps. Alternatively, according to some embodiments, array 300 comprises an array of fewer than eight motors, such as for example, two-seven motors. Furthermore, according to some embodiments, the motors 350 are standardized as discussed above in connection with motors 250. Accordingly, the same motors would be used in tools having differing numbers of motors. Thus whether repairing a tool having a four motor array or a larger tool having a fourteen motor array, all the motors would be the same and interchangeable. Accordingly, at a rig-site, a common stock of interchangeable motors could be keep are used for repairs regardless of the size of the tool being employed. According to some embodiments, standardization is achieved along attachment lines. For example, one standardized part would comprise a replaceable cartridge comprising a motor having a rotor with a torsion rod section coupled to a gear while a second standardized part would comprise a replaceable cartridge comprising a motor having a rotor with a torsion rod section coupled to a particular drive mechanism.

FIG. 4 is a perspective view of a power generation module 400 according to one embodiment of the present disclosure. The power generation module comprises a housing 412 extending longitudinally along a central axis C. According to some embodiments, a down-hole central cavity 415 is formed in the housing 412 and extends from an up-hole end of the housing 412 to a down-hole end 412*b* of the housing 412. The power generation module 400 comprises a number of motors such as motors 250/350 described above. As illustrated, the power generation module 400 comprises four motors. The rotors of the motors are coupled to gears 470. As mentioned above, the gears 470 on an outside diameter 480 of a portion of the housing 412 may be employed to mate with and drive an inside diameter of a bit sub shaft (not shown) to drive the bit sub shaft.

According to some embodiments, down-hole ends 440*b* of the rotors extend beyond an intermediate down-hole end 412*c* of the housing 412.

Figure 5A:
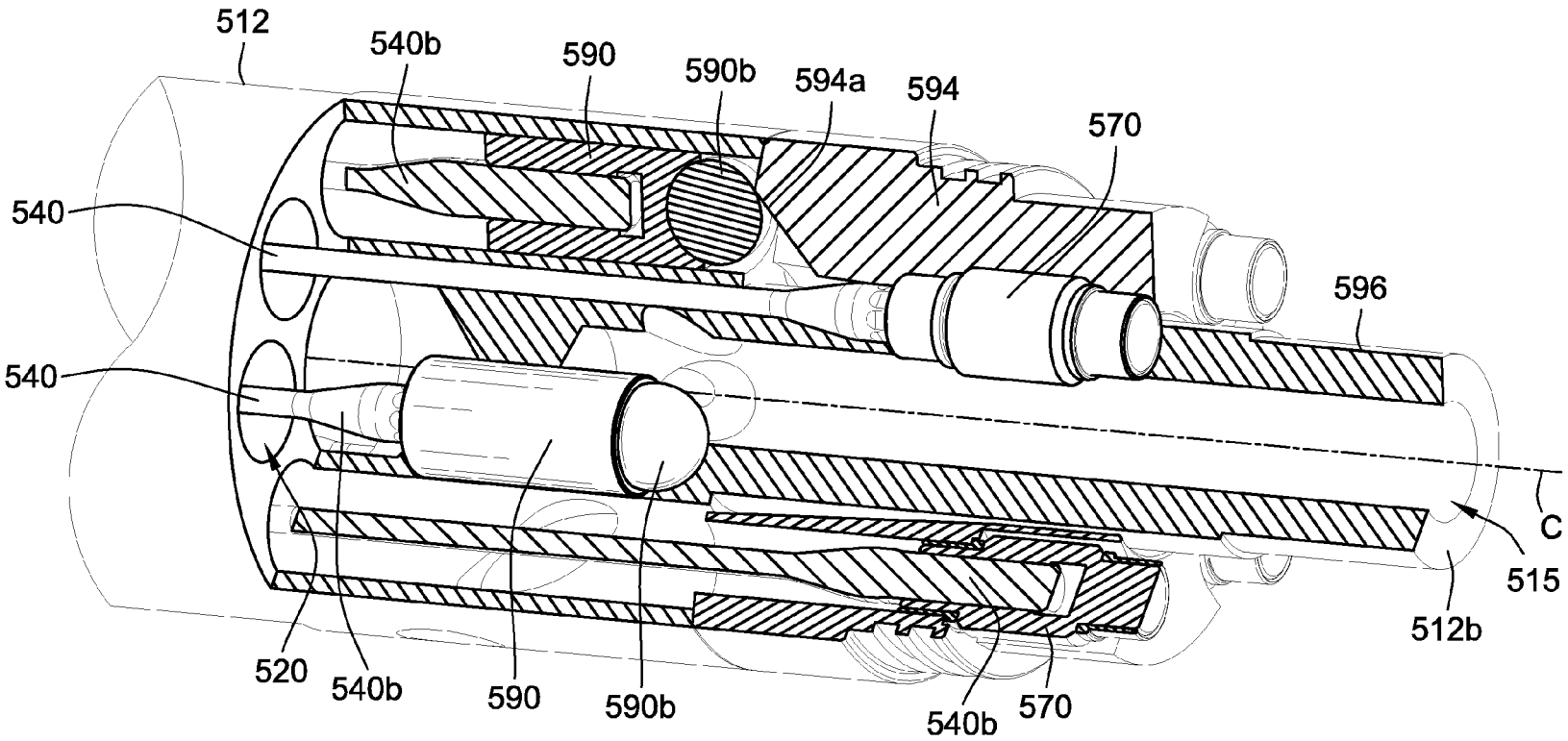
FIG. 5A is a perspective view of a steering and drive module according to one embodiment of the present disclosure.
Figure 5B:
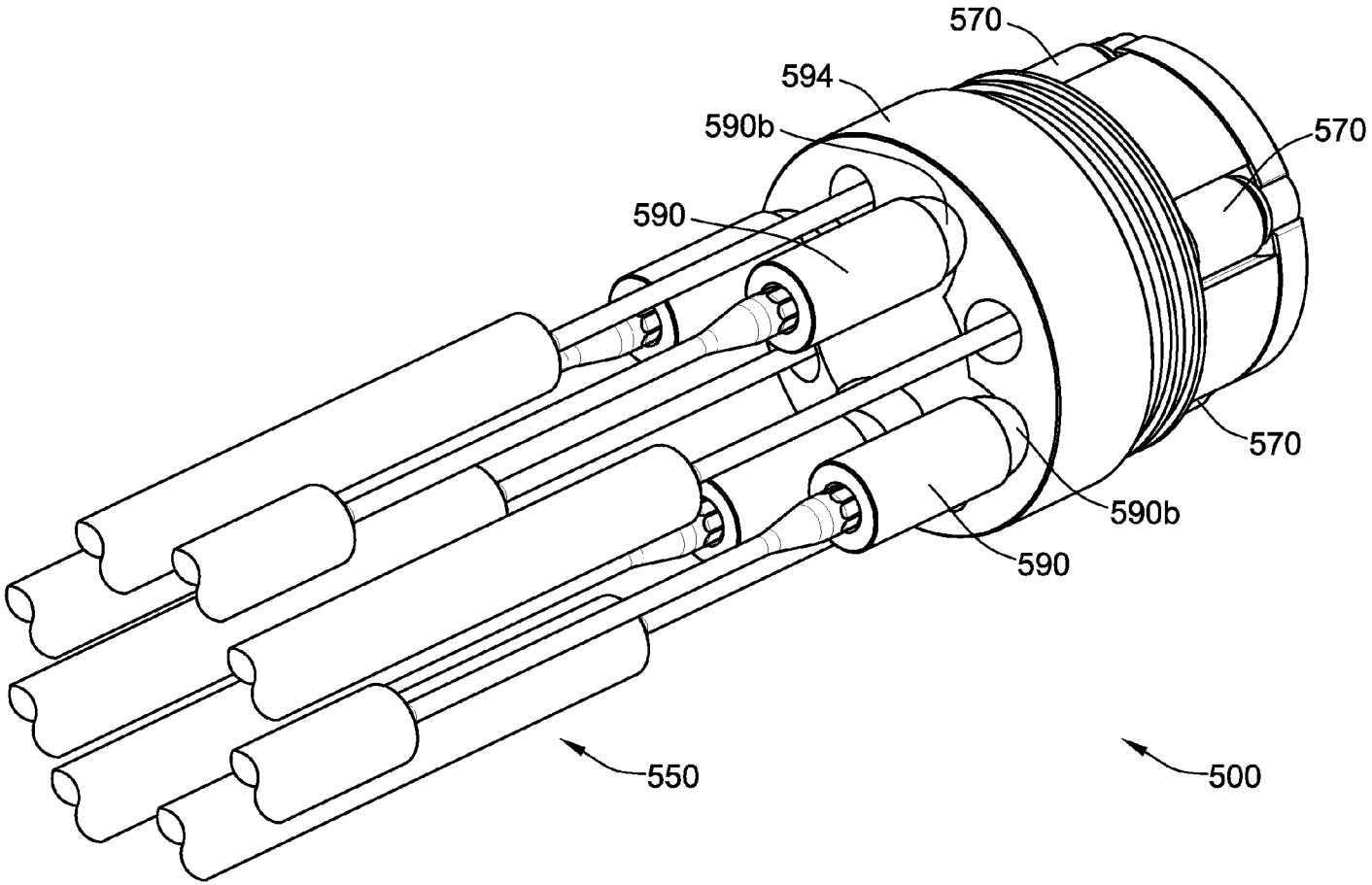
FIG. 5B is an alternate perspective view of a drive module with a housing omitted.

FIG. 5A is a perspective partially cut-away view of a steering and drive module 500 according to one embodiment of the present disclosure. The module 500 comprises a housing 512 extending longitudinally or axially along and about a central axis C. FIG. 5B is an alternate perspective view of the drive module 500 with the housing 512 omitted. According to some embodiments, a down-hole central cavity or bore or standpipe 515 is formed in a least at portion of the housing 512 and extends from a down-hole end 512*b* of the housing 512 at least a portion of the way toward an up-hole ends of the housing 512. A pilot 596 of the housing 512 is illustrated in FIG. 5A. According to some embodiments, the housing alternatively or additionally comprises a plurality of motor/pump bores or cavities 520 extending longitudinally generally parallel to but off-axis from the central axis C of the housing. Positioned within each cavity 520 is a stator (not shown). Positioned within each stator is a rotor 540. Each rotor 540 and stator pair form a motor. According to some embodiments, the motors employed in the module 500 are the same or similar to motors 250/350.

As illustrated, the down-hole ends 540*b* of rotors 540 are coupled to various attachments and/or employed in various manners. As illustrated in FIGS. 5A-5B, gears 570 are coupled to the down-hole ends 540*b* of some of the rotors 540. Steering mechanism drives 590 are coupled to the down-hole ends 540*b* of others of the rotors 540. According to some embodiments, the steering mechanism drives 590 comprise balls 590*b*.

According to some embodiments, valving is used to control flow into the power section from the up-hole end (or top) or down-hole end (or bottom) to control the steering mechanism drives 590 to mechanically steer a drilling tool associated with the module 500. By controlling the direction of the flow of drilling fluid through one or more motors in an array, the motors can be controlled to operate in a forward or reverse direction. According to some embodiments, the steering mechanism drives 590 comprise a screw jack derivative driving an inclined plane 594*a* of a steering head 594 or a pair of eccentrics (not illustrated) or a clutch (not illustrated). High speed operation (such as by employing one-two configuration motors) is complimentary to either actuator technology allowing the use of mechanical advantage without loss of actuation speed. Differential pressure for driving the motors can be between the standpipe and the annulus or between different sections of the standpipe.

Figure 6A:
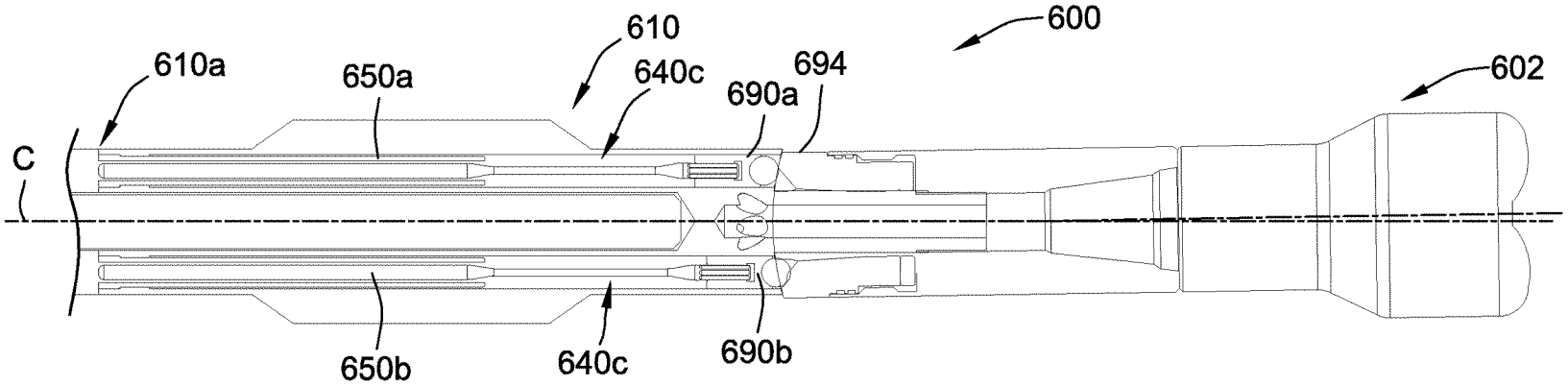
FIG. 6A is a side cross-sectional view of a drilling tool comprising a multiple motor array module and a bit assembly according to one embodiment of the present disclosure.
Figure 6B:
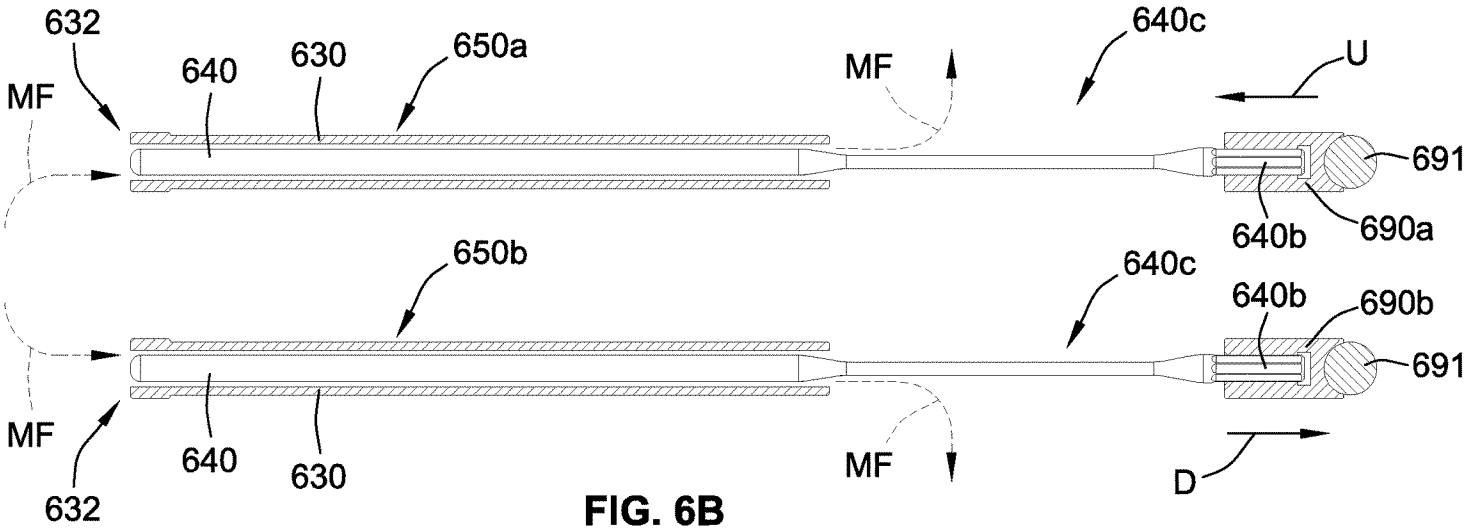
FIGS. 6B-6D illustrate side cross-sectional views of motors according to embodiments of the present disclosure.
Figure 6C:
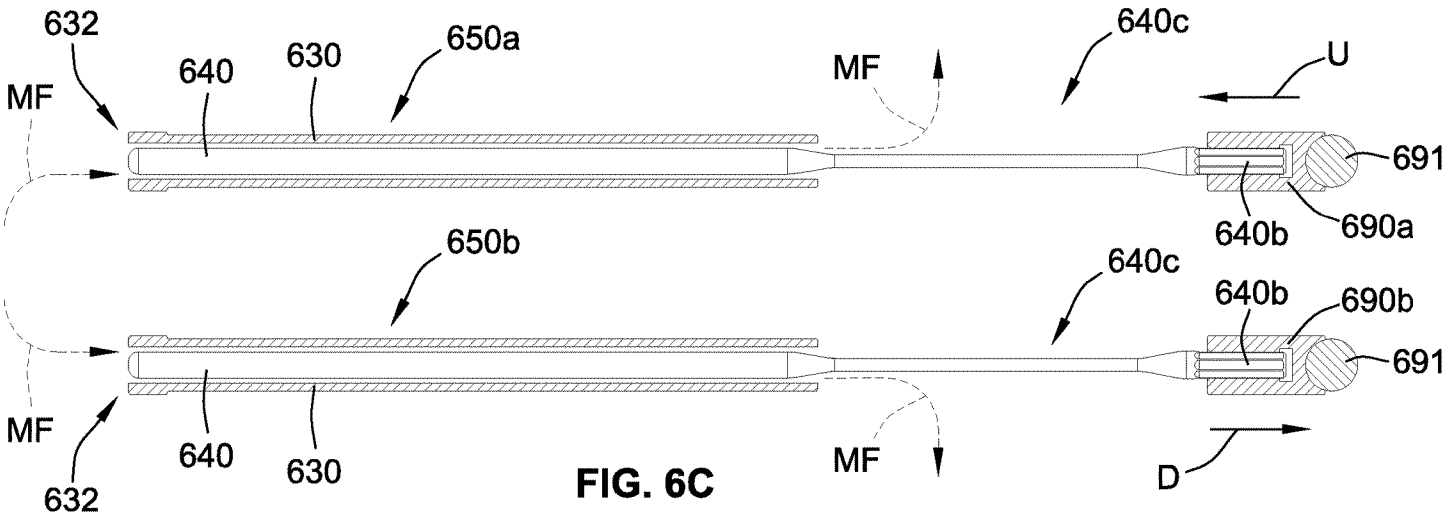
Figure 6D:
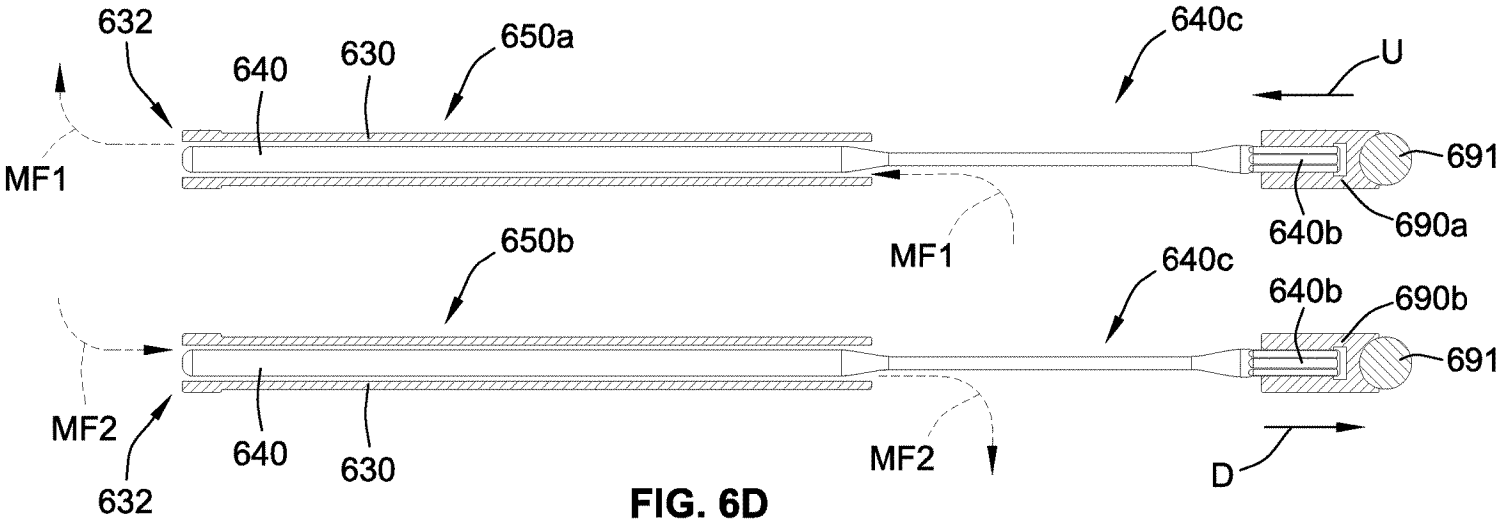

FIG. 6A is a side cross-sectional view of a drilling tool 600 comprising a multiple motor array module 610 and a bit assembly 602. In the illustrated embodiment, the multiple motor array module 610 comprises two or more steering motors 650 such as motors 650*a* and 650*b*. Motors 650*a* and 650*b* comprise rotors 640 having a torsion rod section 640*c*. The rotors 640 are coupled to steering mechanisms 690*a*, 690*b*. As illustrated, the steering mechanisms 690*a*, 690*b* comprises a screw jack element in a threaded bore and a ball 691. The steering mechanisms 690*a*, 690*b* can translate the rotational movement of a stator 640 in one direction into a linear or axial movement of the steering mechanisms 690*a*, 690*b* such as in direction U or D shown in FIGS. 6B-6D. FIGS. 6B-6D illustrate side cross-sectional views of motors 650*a* and 650*b* and will be used to describe alternate embodiments for steering the drilling tool 600. When pressurized from one end of a stator cavity 632, drilling fluid will flow through the stator cavity 632 and a rotor 640 within the stator cavity 632 will be forced to turn or rotate and pass a positive displacement along the length of a corresponding stator 630 until the drilling fluid exits the opposite end of the stator cavity. Down-hole ends 640*b* of each stator 640 are threaded and are configured to threadingly engage the interior of actuators 690*a*, 690*b*. The threaded engagement between the ends 640*b* of each stator 640 and an associated actuator 690*a*, 690*b* can be in either a left hand or right hand direction. The rotation of a stator 630 will be left hand or right hand depending on the direction of the helix of the rotor/stator. The rotation of a stator 630 will further be left hand or right hand depending on which end of the motor 650 is pressurized. According to some embodiments, to accomplish steering, actuators 690*a*, 690*b* attached to opposite sides of a steering head 694 operate such that the actuator of one side, e.g., 690*a*, moves in a down-hole direction while the opposite side actuator, e.g., 690*b*, simultaneously moves in a up-hole direction. This can be accomplished in several ways.

In FIG. 6B, the actuators 690*a*, 690*b* on opposite sides of the steering head 694 have the same rotor/stator helix orientation and are both pressurized from an up-hole end 610*a*. However, the threaded end 640*b* of the opposite steering actuator pair 690*a*,690*b* are threaded in opposite directions. Thus, in operation when drilling fluid flows through both motors 650*a*, 650*b* in the same direction MF (up-hole to down-hole as illustrated in FIG. 6B), the associated stators 640 will revolve in the same direction which will cause the actuators 690*a*,690*b* to move in opposite directions. As illustrated in FIG. 6B, drilling fluid flowing through the motors 650*a*,650*b* in direction MF will cause actuator 690*a* to move in an up-hole direction (arrow U) and will cause actuator 690*b* to move in a down-hole direction (arrow D). This configuration has the benefit of employing a common motor section and common pressurized end for valving simplicity.

In FIG. 6C, the actuator pair 690*a*, 690*b* has opposite helix direction in the motor rotor/stator itself. With common up-hole pressurization and common actuator end threads, the opposite rotation of the motors 650*a*,650*b* due to their opposite helix directions cause the opposing actuators 690*a*, 690*b* to move opposite each other. Thus, in operation when drilling fluid flows through both motors 650*a*, 650*b* in the same direction MF (up-hole to down-hole as illustrated in FIG. 6C), the associated stators 640 will revolve in opposite directions which will cause the actuators 690*a*,690*b* to move in opposite directions as each is threaded in the same direction. As illustrated in FIG. 6C, drilling fluid flowing through the motors 650*a*,650*b* in direction MF will cause actuator 690*a* to move in an up-hole direction (arrow U) and will cause actuator 690*b* to move in a down-hole direction (arrow D).

In FIG. 6D, motors 650*a*,650*b* have a common helix direction and a common end 640*b* thread direction. Tool 600 direction is controlled by directing pressure to opposite ends of the opposing steering pair of motors 650*a*,650*b*. More specifically, as illustrated, pressure is controlled to cause drilling fluid to flow in a down-hole to up-hole direction through motor 650*a* and in a up-hole to down-hole direction through motor 650*b*. As illustrated in FIG. 6D, drilling fluid flowing through the motors 650*a*,650*b* in directions MF1 and MF2 will cause actuator 690*a* to move in an up-hole direction (arrow U) and will cause actuator 690*b* to move in a down-hole direction (arrow D). Note that all three configurations described in connection with FIGS. 6B-6D require the cycling of the actuators 690*a*, 690*b* in both directions, hence valve control of pressurization to the up-hole and down-hole end of the steering motors 650*a*, 650*b* is contemplated for all three configurations according to some embodiments. That is, by using valves according to some embodiments, the flow of drilling fluid through the motor 650*a*, 650*b* can be altered from a down-hole direction to an up-hole direction.

Figure 7A:
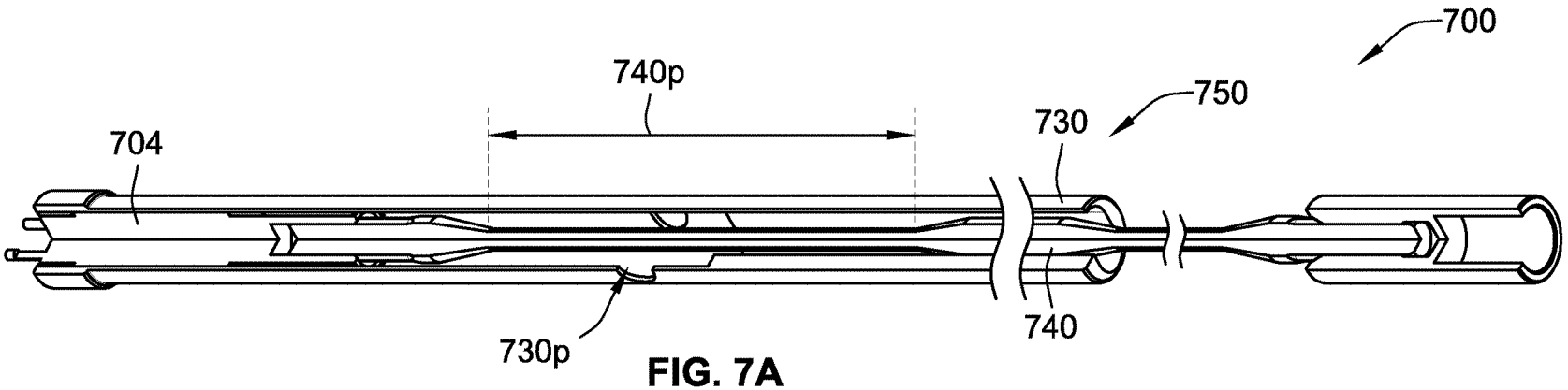
FIG. 7A is a cut-away perspective view.
Figure 7B:
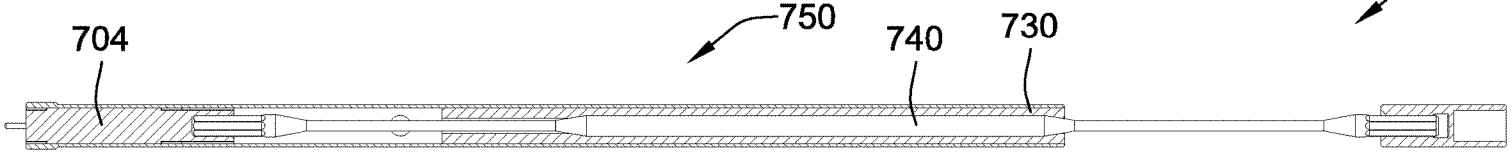
FIG. 7B is a side cross-sectional view.
Figure 7C:
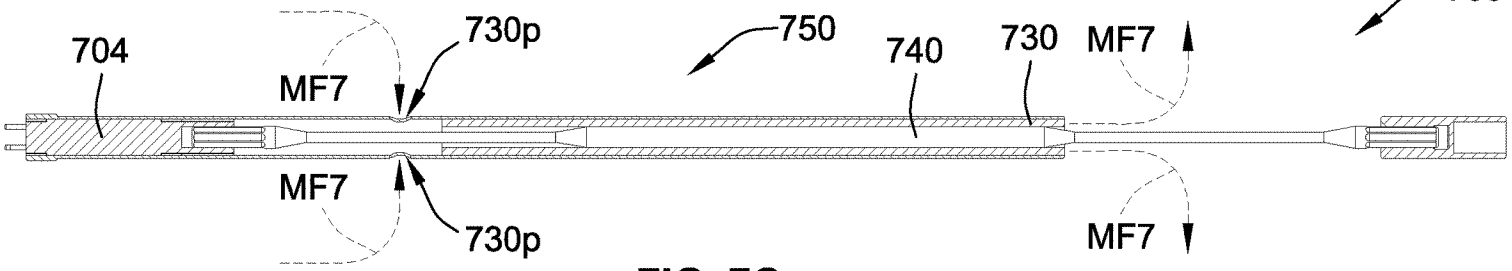
FIG. 7C is a top cross-sectional view of an electrical power generation module according to one embodiment of the present disclosure.

FIG. 7A is a cut-away perspective view, FIG. 7B is a side cross-sectional view, and FIG. 7C is a top cross-sectional view of an electrical power generation module 700 according to one embodiment of the present disclosure. As illustrated, the electrical power generation module 700 comprises a single motor 750 coupled to an alternator or generator 704. According to some embodiments, the electrical power generation module 700 comprises a plurality of motors 750/alternators or generators. For example, an alternator or generator can be coupled to one or more motors such as motors 250/350 described herein and may be arranged in a variety of configurations such as described in connection with FIGS. 2A-6D. The motor 750 comprises a stator 730 and rotor 740. According to some embodiments, the motor 750 is the same of similar to motor 250 described above. As illustrated in FIG. 7A, a drilling fluid feed port 730*p* is located within a side of the stator 730. The diameter of the rotor 740 is reduced in an area 740*p* located near the drilling fluid feed port 730*p* to facilitate the in-flow or out-flow of drilling fluid into or out of the stator and also facilitate the alternator/generator 704 staying on axis even though the rotor of a progressive cavity pump style motor (such as a one-two configuration motor) is orbiting or moving eccentrically within its associated stator. The reduced diameter portion of the rotor 740 in area 740*p* is flexible. Exemplary drilling fluid flow directions MF7 are illustrated in FIG. 7C. As illustrated in FIG. 7C, on the down-hole end of motors 750, drilling fluid may flow to an inner bore and/or to an outside annulus.

According to some embodiments, element 704 is an electrical motor which drives rotor 740 to cause element 750 to act as a pump and/or is used to drive a steering mechanism coupled to a down-hole end of rotor 740.

According to some embodiments, while one or more one-two configuration motors 750 located down-hole in a drilling tool are running at high speed, one end of the associated rotors 740 are employed to drive a bit subassembly as described herein while at the same time the other ends of the rotors 740 are employed to drive generators or alternators 704. Alternatively, one or more of a plurality of motors in a drilling tool may be dedicated solely to driving a bit subassembly as described herein while one or more other of the plurality of motors in the drilling tool may be solely to generating electrical power—that is, in a multiple motor array, a first set of one or more of the motors are coupled to generator(s) or alternator(s) but are not employed to drive a bit subassembly while a second set of one or more other motors in the array are employed to drive a bit subassembly (e.g., have a gear coupled to down-hole ends of the associated stators) while not being coupled to generator (s) or alternator(s).

According to some embodiments, the high speed nature of simple high speed multi-lobe power sections (such as a one-two configuration motors) make them suited for generating electrical energy. According to some embodiments, an electrical power generation module such as module 700 is employed in conjunction with and to compliment a down-hole battery pack. The module 700 can be used to operate a generator or alternator 704 off the rotor 740. Several of these modules 700 can be used in an array to provide sufficient electrical energy to meet the requirements for a drilling tool. According to some embodiments, valving is employed in connection with these modules 700 to selectively to increase or decrease available electrical power. By valving the drive motor array, flow through an associated standpipe and through one or motors 750 can be dedicated to producing electrical power during periods when drilling is not being performed by an associated drilling tool, such as to recharge batteries or for survey instrumentation purpose.

According to some embodiments, the motors 250/350 and motor arrays described herein are employed in connection with hydraulic or drilling fluid differential power pump applications—that is, the motors 250/350 in the above described in embodiments operate as pumps instead of motors. For example, according to some embodiments, one or more motors/pumps 250/350 of an array can be dedicated to the production of fluid power by driving a pump. According to some embodiments, the pump is hydraulic. According to some embodiments, the pump is used to increase the pressure of drilling fluid above an associated standpipe pressure to drive steering components, antirotation housings, tractor mechanisms, or any number of other fluid driven mechanisms, including washout jets. According to some embodiments, the rotors 240 within motors/pumps 250/350 of an array are driven (such as by, for example, gears) by a conventional power section up hole. According to some embodiments, the rotors 240 within motors/pumps 250/350 of an array are driven by drilling fluid flow as otherwise described herein and the rotors drive a conventional hydraulic pump to pump a hydraulic oil for use for various actuations within an associated tool.

According to some embodiments, the motors 250/350 and motor arrays described herein are employed in connection with a composite function application, such as for example, the steering and drive module 500 and multiple motor array module 610 described above in connection with FIGS. 5A-5B and 6A-6D. According to some embodiments, a motor array such as the arrays described herein can be configured and employed to serve dedicated, composite, and/or combinations of applications. For example, an array can comprise individual motors all of which are employed for drive applications, for example, such as having rotors coupled to gears dedicated to drive a drill bit—such as shown in FIG. 2A which illustrates the array of single purpose drive motors. Alternatively, according to some embodiments, an array can be a composite of individual motors having different functions such as a subset of motors for drive and a second subset of motors for electrical power generation—such as shown in FIGS. 5A-5B which illustrates a composite array of drive and steering motors and/or a third set for hydraulic power generation. Alternatively, individual motors of an associated array can be employed to serve multiple functions. For example, a motor or power section providing a drive function may simultaneously drive electrical generation off the opposite end of the rotor and/or another section providing a steering function may simultaneously drive hydraulic generation off the opposite end of the rotor. FIGS. 7A-7C show a combination of drive and electrical power generation in connection with an individual rotor/stator combination. Redundancy in both drive and electrical functions ensures failure of an individual motor or section does not result in total failure of the array or associated module or tool.

Figure 8A:
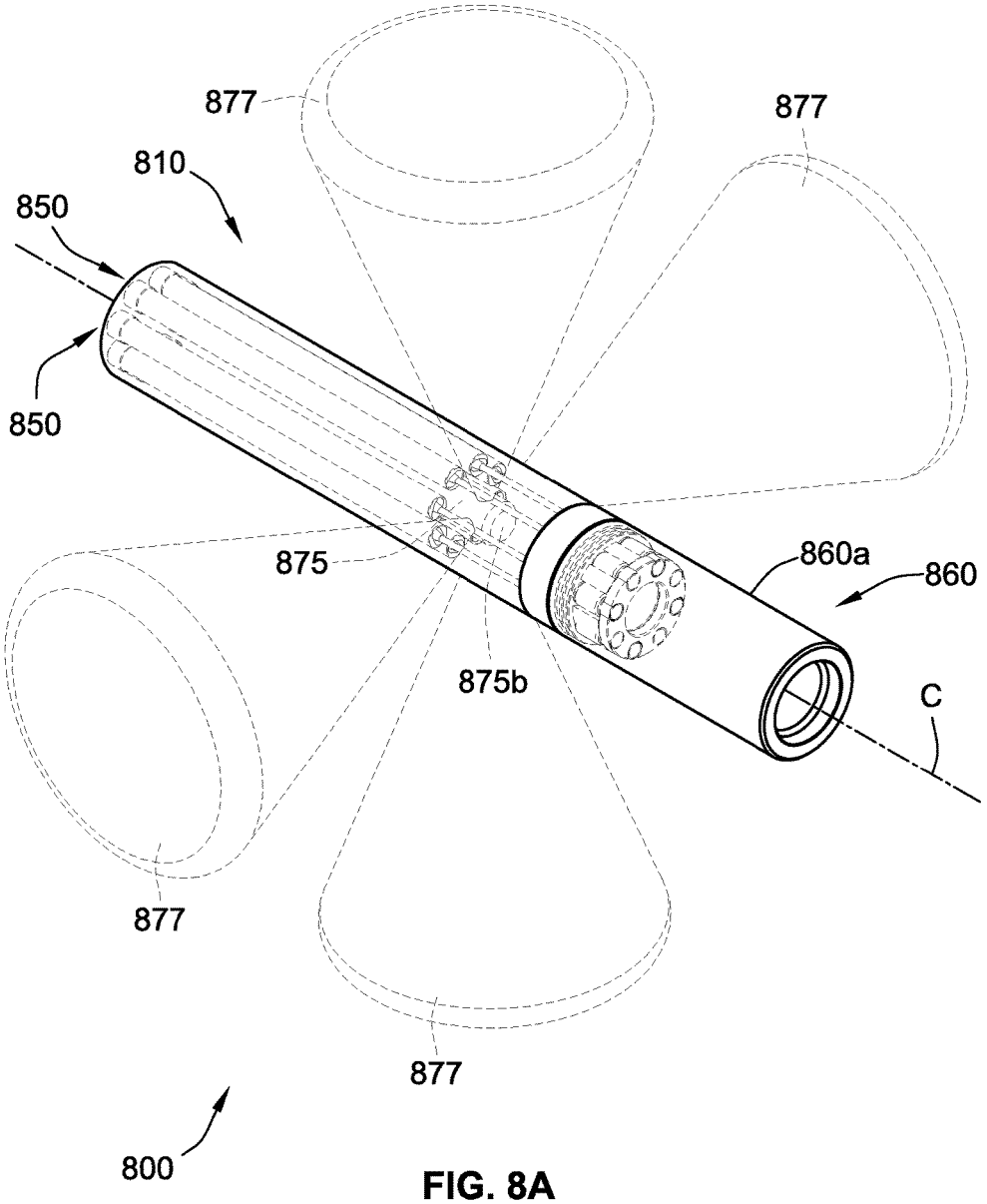
FIG. 8A is a perspective view of a drilling tool according to one embodiment of the present disclosure.

FIG. 8A is a perspective view of a drilling tool 800 according to one embodiment of the present disclosure. The drilling tool 800 comprises a drive section 810 comprising a multiple motor array similar to that illustrated in FIG. 3B and a bit subassembly 860 similar to that illustrated in FIG. 3B. The drive section 810 and the bit subassembly 860 are contained within a housing 860*a* of the drilling tool 800. A sensor assembly 875 containing one or more sensors is positioned in between the motors 850 of the multiple motor array. For example, the drive section 810 may comprise a housing similar to housing 212 discussed in connection with FIG. 2 with the sensor 875 positioned within the central cavity 214. A down-hole end 875*b* of the sensor 875 is positioned adjacent to a torsion section of the drive section 810. The reduced diameter of the rods in the torsion section enhance the ability of the sensor 875 to sense areas outside the tool 800. Exemplary fields of view 877 of sensor 875 are illustrated in FIG. 8A.

Figure 8B:
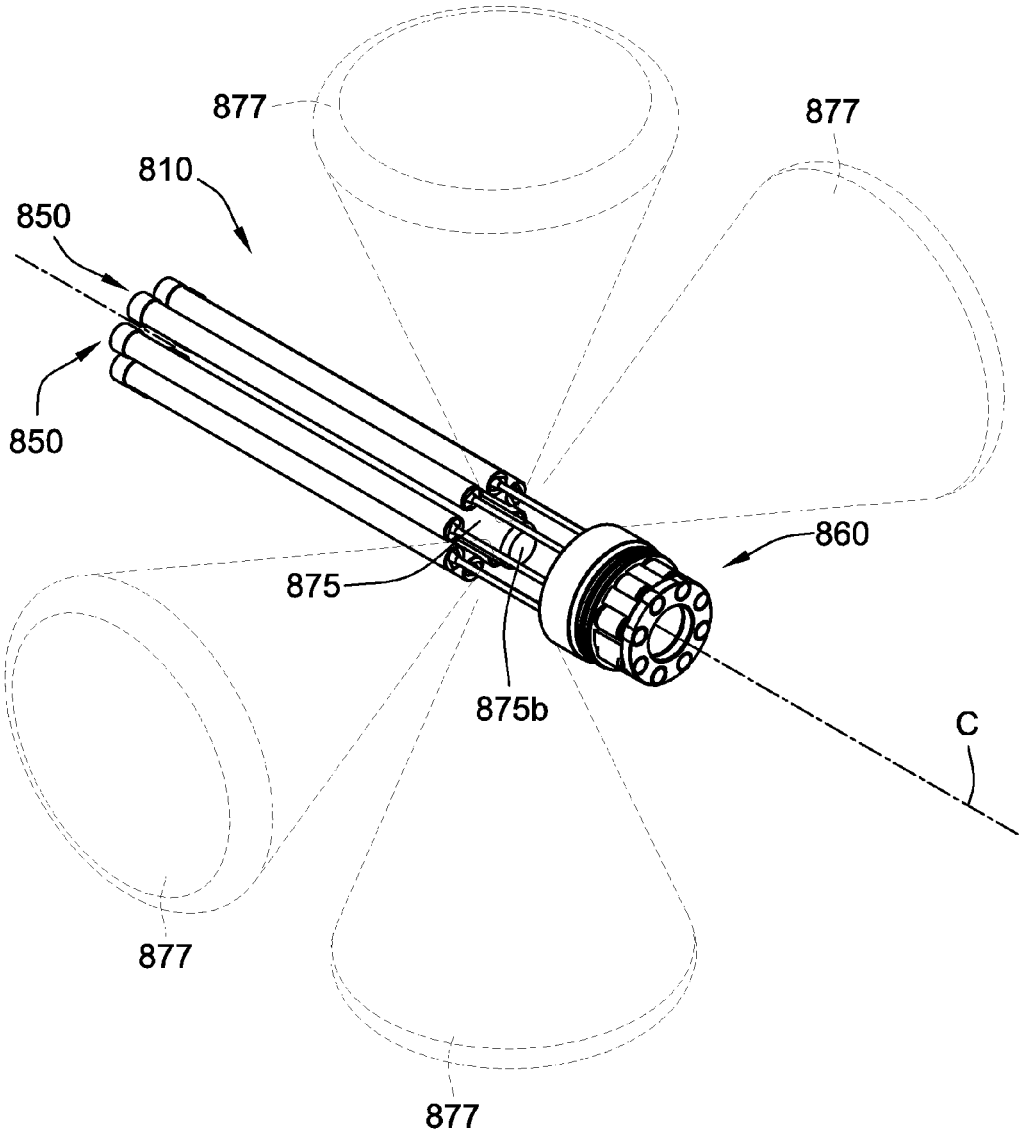
FIG. 8B is a perspective view of a multiple motor array and a portion of a bit subassembly similar to that illustrated in FIG. 8A but with a housing of the drilling tool being omitted according to one embodiment of the present disclosure.

FIG. 8B is a perspective view of a multiple motor array 815 and a portion of a bit subassembly 860 similar to that illustrated in FIG. 8A but with the housing 860*a* of the drilling tool 800 being omitted. In a manner similar to that described above in connection with FIG. 8A, a sensor 875 is positioned within a central area defined by the multiple motor array 815. As in FIG. 8A, exemplary fields of view 877 of sensor 875 are illustrated in FIG. 8B.

Figure 8C:
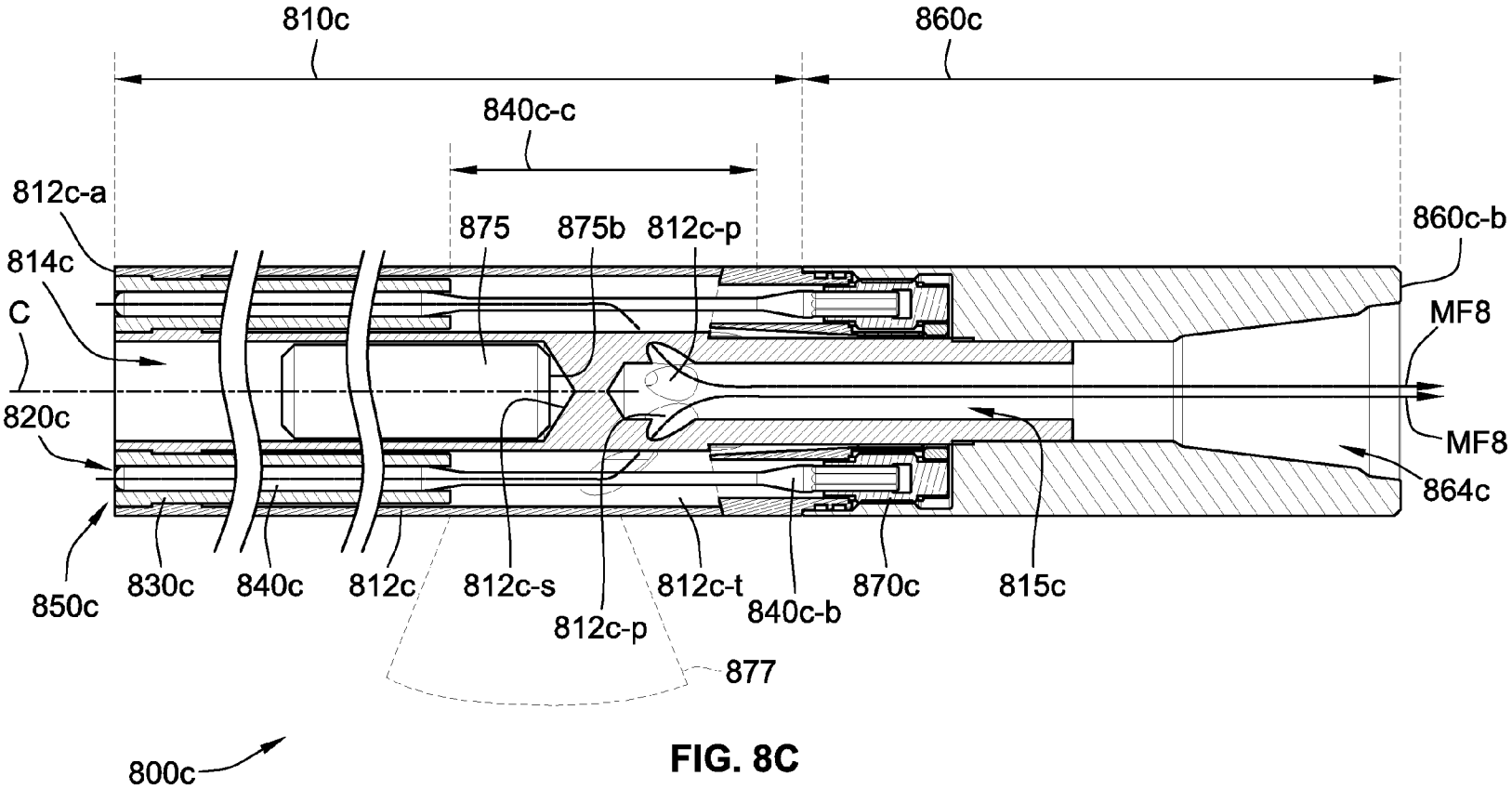
FIG. 8C is a cross-sectional side view of a drilling tool according to one embodiment of the present disclosure.

FIG. 8C is a cross-sectional side view of a drilling tool 800*c*. The drilling tool 800*c* comprises a drive section 810*c* comprising a multiple motor array similar to that illustrated in FIG. 3B and a bit subassembly 860*c* similar to that illustrated in FIG. 3B. The drive section 810*c* comprises a housing 812*c* extending longitudinally or axially along a central axis C. As illustrated, an up-hole central cavity 814*c* is formed in the housing 812*c* extending in a down-hole direction from an up-hole end 812*c-a* of the housing 812*c* to a sensor end 812*c-s* of the housing 812. The housing comprises a plurality of motor or pump bores or cavities 820*c* extending longitudinally generally parallel to but off-axis from the central axis C of the housing 812*c*. Positioned within each cavity 820*c* is a stator 830*c*. Positioned within each stator 830*c* is a rotor 840*c*. Each rotor 840*c* and stator 830*c* pair form a motor 850*c*. Accordingly, according to some embodiments, an array of motors 850*c* is provided wherein each motor 850*c* extends generally longitudinally parallel to the other motors 850*c* in the array but wherein each motor 850*c* is displaced radially from a central axis C. As illustrated, down-hole ends 840*c-b* of rotors 840*c* are coupled to gears 870*c*. According to some embodiments, each rotor 840*c* and stator 830*c* is a progressive cavity pump style motor based on the Moineau principle. According to some embodiments, each motor 850*c* has a one-two configuration.

A sensor assembly 875 containing one or more sensors is positioned within the up-hole central cavity 814*c* of the housing 812*c* near the down-hole end 812*c-s* of the up-hole central cavity 814*c*. A down-hole end 875*b* of the sensor 875 is positioned adjacent to a torsion section 840*c-c* of the drive section 810*c*. The reduced diameter of the rotors 840*c* in the torsion section 840*c-c* enhance the ability of the sensor 875 to sense areas outside the tool 800. An exemplary field of view 877 of sensor 875 is illustrated in FIG. 8C. As illustrated, the gears 870*c* interface with the bit subassembly 860*c* in manner similar to that discussed above in connection with FIGS. 3D-3E.

In operation, drilling fluid flows from an up-hole end 812*c-a* of the housing through the motors 850*c* causing the rotor 840*c* within in each motor 850*c* to rotate within a corresponding stator 830*c*. Drilling fluid exists of the motors 850*c* and enters torsional cavities 812*c-t* in the torsional section of the drive section 810*c*. Drilling fluid then flows through ports 812*c-p* into a down-hole central cavity 815*c* of the housing 812*c* and then into a central cavity 864*c* of the bit subassembly 860*c* and out of a down-hole end 860*c-b* of the bit subassembly 860*c* toward one or more down-hole drill bits.

Figure 8D:
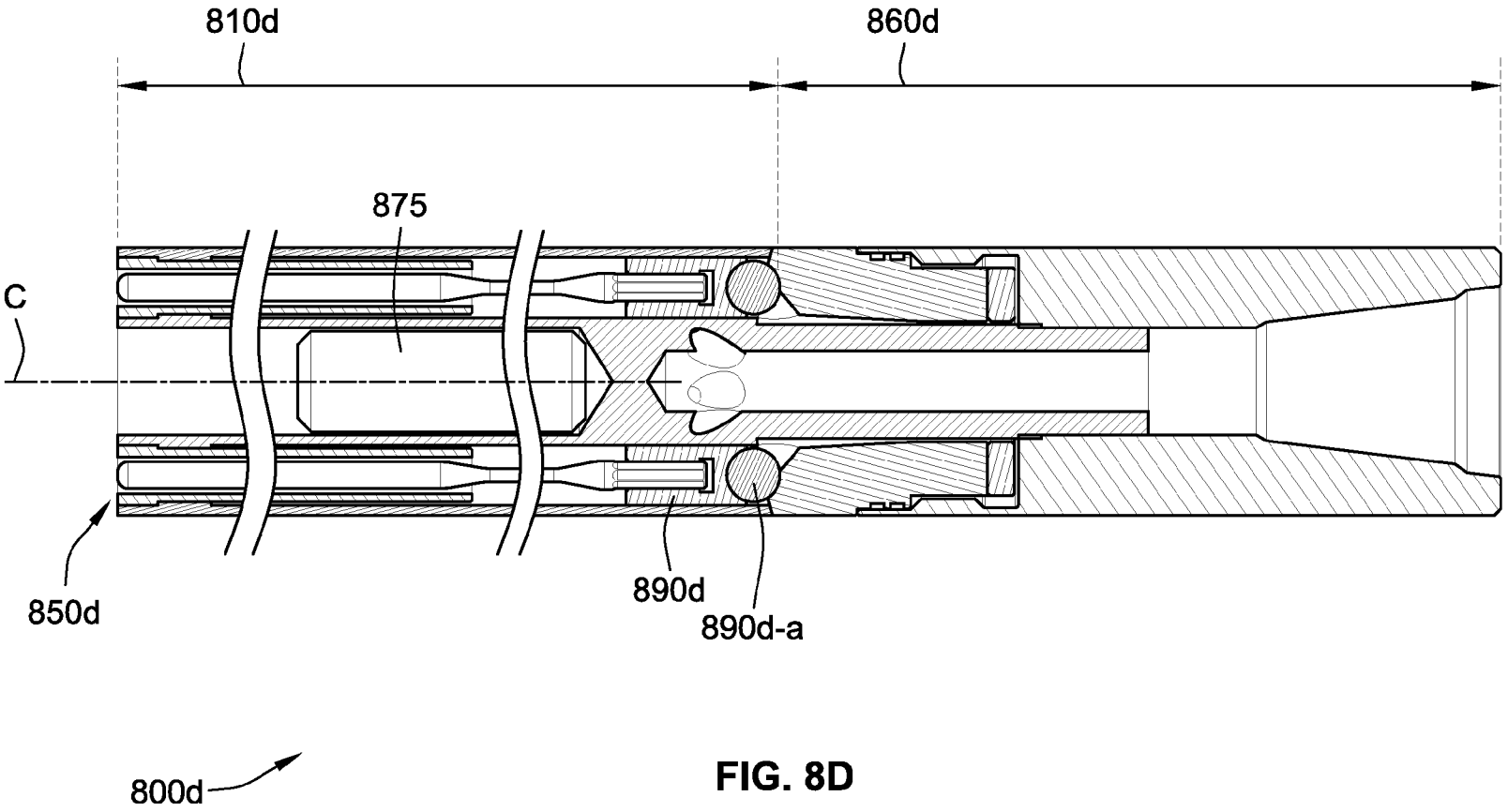
FIG. 8D is a cross-sectional side view of a drilling tool according to one embodiment of the present disclosure.

FIG. 8D is a cross-sectional side view of a drilling tool 800*d*. The drilling tool 800*d* comprises a drive section 810*d* comprising a multiple motor array similar to that illustrated in FIG. 3B and a bit subassembly 860*d* similar to that illustrated in FIG. 3B. The drilling tool 800*d* is identical to drilling tool of 800*c* of FIG. 8C except that gears 870*c* are replaced with steering mechanism drives 890*d*. According to some embodiments, the steering mechanism drives 890*d* comprise balls 890*d-b* such as described above in connection with FIG. 5.

According to some embodiments, drilling tool 800*c* and drilling tool 800*d* is the same tool with the cross-section side views being taken along different planes. That is, FIGS. 8C and 8D illustrate a drilling tool similar to that illustrated and described in connection with FIG. 5 wherein some of the down-hole ends of rotors 840 are coupled to drive mechanisms such as gears 870 while other down-hole ends of rotors 840 are coupled to steering mechanisms.

The embodiments of the present disclosure have the potential to address a variety of trends that are challenging the present design philosophy:

- Ever increasing drilling fluid motor performance is exceeding mechanical and metallurgical limits of around bend drive train components such as the strength of constant velocity shafts and torsion shafts.
- The desire for more powerful down hole drilling tools in small diameters.
- Increasing operating environment temperatures are pushing the limits of power section elastomers, particularly in more aggressive drilling fluid recipes.
- The electrical appetite in bottom hole assemblies is taxing both communication wire power transmission capability and battery technology. Accordingly, there is a desire is to have electrical power generation capability at the down-hole consumption point.

As conventional single drilling fluid motor power sections are getting more and more powerful, they are starting to run into limits of the strength of the constant velocity shafts, and the torsion shafts for making it around a bend. Some embodiments in the present disclosure mitigate some of these problems by splitting torque up into many smaller, faster turning motors, passing the lower torques around a bend, then recombining the high speed low torque into low speed high torque at the bit. As discussed above, according to some embodiments, multiple smaller high speed motors are employed to commonly drive a down-hole drive section at lower speed but with higher torque such as described above.

According to some embodiments, solid rotors may be employed in connection with the embodiments described above. For example, according to some embodiments, a solid rotor/stator construction in metal or thermoplastic may be employed for power density and high temperature operation benefits. For example, some embodiments may employ a solid metal rotor and a metal stator. Other embodiments may employ a solid metal rotor and a thermoplastic stator. Use of solid rotor/stator motors such as in, for example, a one-two configuration motor avoids the need to employ elastomers which are susceptible to deterioration at high temperatures and/or high pressures. According to some embodiments, the axially or longitudinal lengths of multiple motor arrays employing solid rotor/stator motors can be significantly shorter than an equivalent power section employing non-solid rotor/stator motors utilizing elastomers. For example, according to some embodiments, multiple motor arrays employing solid rotor/stator motors may have an axially or longitudinal length of approximately one meter whereas an equivalent power section employing non-solid rotor/stator motors utilizing elastomers would have an axially or longitudinal length of approximately four meters. As a result, the ability of embodiments of the present disclosure to provide very short power sections that can deliver the same power is significantly beneficial for directional drilling applications in which a down-hole assembly needs to proceed around a bend.

Use of turbines also avoids the need to employ elastomers which are susceptible to deterioration at high temperatures and/or high pressures. The array approach also permits shorter turbine sections which mitigate the turbines sensitivity to bending.

According to some embodiments, the motors employed with the embodiments described above employ a one-two configuration, that is, a rotor having one lobe and a stator having two lobes. According to some embodiments, one or more alternators or generators are coupled at the back (or up-hole end) of one or more rotors described herein. According to some embodiments, the rotors to which an alternator or generator is coupled are one lobe rotors employed in a one-two configuration motor which is a high speed type of motor configuration. Alternators and/or generators usually require to be driven at high speed to generate a significant amount of power. Accordingly, some embodiments of the present disclosure advantageously employ alternators and/or generators coupled to the rotors of one-two configuration motors which operate at a high rate of speed (that is, the associated rotors rotate at a high rate of speed) and thus facilitate the generation of a significant amount of power by the alternators and/or generators coupled thereto. For example, with a typical drilling fluid motor running a bit directly, 350-400 rpm would be an upper limit. These rotational speeds are not suitable for electrical power generation with alternators and generators. Thus gears would need to be employed to increase the available rpm which presents a number of problems. Conversely, according to some embodiments of the present disclosure, the motors described above employing one-two configuration motors and/or turbines may operate at 800-1200 rpm.

According to some embodiments is a drive section is provided comprising: a housing having a central longitudinal axis, the housing having an up-hole end and a down-hole end, the housing having a plurality of cavities arranged radially about the central axis, each cavity extending longitudinally generally parallel to the central axis; a stator positioned in each cavity, each stator having a stator cavity; and a rotor positioned within each stator cavity; wherein the rotor and stator cooperate so fluid (such as, for example, drilling fluid or compressed air or nitrogen) passing through each stator cavity causes each rotor to rotate within a respective stator, or alternatively, causes each stator to rotate about a respective rotor.

While particular embodiments and applications of the present disclosure have been illustrated and described, it is to be understood that the disclosure is not limited to the precise construction and compositions disclosed herein and that various modifications, changes, and variations may be apparent from the foregoing descriptions without departing from the spirit and scope of the disclosure as defined in the appended claims.

What is claimed is:

1. A drive section comprising:

a housing comprising a central longitudinal axis, the housing comprising:
  an up-hole end;
  a down-hole end; and
  a plurality of cavities arranged radially about the central axis, each cavity extending longitudinally generally parallel to the central axis;

a stator positioned in each cavity, each stator comprising a stator cavity;

a rotor positioned within each stator cavity;

wherein the rotor and stator cooperate so fluid passing through each stator cavity causes each rotor to rotate within a respective stator; and wherein each stator/rotor pair constitutes a motor, wherein one or more of the motors do not employ an elastomer.

2. The drive section of claim 1 wherein each rotor comprises a coupling on at least one of a down-hole end and an up-hole end of the rotor.

3. The drive section of claim 2 wherein at least one of the couplings on one or more of the rotors is positioned on the down-hole end of the rotor and wherein the coupling is a drive mechanism.

4. The drive section of claim 2 wherein at least one of the couplings on one or more of the rotors is positioned on the down-hole end of the rotor and wherein the coupling is a steering mechanism.

5. The drive section of claim 2 wherein:

the couplings on a plurality of the rotors are positioned on the down-hole end of the rotor;

at least one of the couplings on the down-hole end is a steering mechanism; and at least one of the couplings on the down-hole end is a drive mechanism.

6. The drive section of claim 1 wherein at least one of the rotors is coupled to at least one of a generator and an alternator.

7. A multiple pump array module for a drilling tool comprising:

a plurality of pumps extending axially along generally parallel axes wherein the pumps are positioned along the axes next to each other in a parallel manner in generally the same axial location; and wherein rotational movement of each pump forces fluid to pass through each pump and on to at least one motor.

8. The multiple pump array module of claim 7 wherein the pumps are progressive cavity pump style pumps based on the Moineau principle.

9. The multiple pump array module of claim 8 wherein the pumps have a one-two configuration.

10. The multiple pump array module of claim 7 wherein the axes of the plurality of pumps are positioned about but displaced from a central generally parallel axis C by the same distance r.

11. The multiple pump array module of claim 7 wherein the axes of the plurality of pumps are positioned about but displaced from a central generally parallel axis C and wherein the pumps are arranged in a plurality of concentric rings about the central axis C.

12. A multiple pump and motor array module for a drilling tool comprising:

one or more motors extending axially along generally parallel motor axes;

one or more pumps extending axially along generally parallel pump axes; and wherein the motors and pumps are positioned along the motor and pump axes next to each other in a parallel manner in generally the same axial location.

13. The multiple pump and motor array module of claim 12 wherein the pumps are progressive cavity pump style pumps based on the Moineau principle and the motors are progressive cavity pump style motors based on the Moineau principle.

14. The multiple pump and motor array module of claim 13 wherein the pumps and motors have a one-two configuration.

15. The multiple pump and motor array module of claim 12 wherein the axes of the plurality of pumps and motors are positioned about but displaced from a central generally parallel axis C by the same distance r.

16. The multiple pump and motor array module of claim 12 wherein:

the pump and motor axes of the plurality of pumps and motors are positioned about but displaced from a central generally parallel axis C;

the pumps are arranged in one or more concentric rings about the central axis C; and the motors are arranged in one or more different concentric rings about the central axis C.

17. The multiple pump and motor array module of claim 12 wherein the motors and pumps are turbines.

18. A drilling assembly comprising:

a string:

a multiple motor array module coupled directly or indirectly to the string;

a drill bit assembly coupled directly or indirectly to the multiple motor array module;

wherein the multiple motor array module comprises a plurality of motors extending axially along generally parallel axes wherein the motors are positioned along the axes next to each other in a parallel manner in generally the same axial location; and wherein the motors do not employ an elastomer.

19. The drilling assembly of claim 18 wherein the motors are progressive cavity pump style motors based on the Moineau principle.

20. The drilling assembly of claim 19 wherein the motors have a one-two configuration.

21. The drilling assembly of claim 18 wherein the axes of the plurality of motors are positioned about but displaced from a central generally parallel axis C by the same distance r.

22. The drilling assembly of claim 18 wherein the axes of the plurality of motors are positioned about but displaced from a central generally parallel axis C and wherein the motors are arranged in a plurality of concentric rings about the central axis C.

23. The drilling assembly of claim 18 wherein the motors are turbines.

* * * * *